US012649610B2

(12) United States Patent
Evatt et al.

(10) Patent No.: US 12,649,610 B2
(45) Date of Patent: Jun. 9, 2026

(54) STORAGE SYSTEM AND CONTAINER FOR SAME

(71) Applicant: TECHTRONIC CORDLESS GP, Anderson, SC (US)

(72) Inventors: Thomas Evatt, Six Mile, SC (US); Jeremy Fedrigon, Greenville, SC (US); Keith Lombardi, Easley, SC (US); Trevor C. Fauss, Greenville, SC (US); Collin C. Burney, Greenville, SC (US)

(73) Assignee: TECHTRONIC CORDLESS GP, Anderson, SC (US)

( * ) Notice: Subject to any disclaimer, the term of this patent is extended or adjusted under 35 U.S.C. 154(b) by 370 days.

(21) Appl. No.: 17/863,169

(22) Filed: Jul. 12, 2022

(65) Prior Publication Data

US 2023/0013694 A1 Jan. 19, 2023

Related U.S. Application Data

(60) Provisional application No. 63/302,934, filed on Jan. 25, 2022, provisional application No. 63/220,801, filed on Jul. 12, 2021.

(51) Int. Cl.

| | |
|---|---|
| ***B65D 25/22*** | (2006.01) |
| ***B65D 43/16*** | (2006.01) |
| ***B65D 43/22*** | (2006.01) |

(52) U.S. Cl.

CPC ..... *B65D 25/22* (2013.01); *B65D 43/16* (2013.01); *B65D 43/22* (2013.01)

(58) Field of Classification Search

CPC ..... B65D 25/22; B65D 25/20; B65D 43/14; B65D 43/16; B65D 43/22; B25H 3/02; B25H 3/00; B25H 3/04; B25H 3/06

See application file for complete search history.

(56) References Cited

U.S. PATENT DOCUMENTS 2,541,828 A 2/1951 Gordon
2,584,219 A 2/1952 Murrell
(Continued)

FOREIGN PATENT DOCUMENTS

AU 2007203111 A1 1/2008
AU 2015101015 B4 9/2015
(Continued)

OTHER PUBLICATIONS

European Search Report Corresponding with Application No. EP22184378 on Apr. 14, 2023 (2 pages).
(Continued)

*Primary Examiner* — Javier A Pagan
(74) *Attorney, Agent, or Firm* — Dority & Manning, P.A.

(57) ABSTRACT

A storage system includes a panel secured to a support surface and a storage container removably supported on the panel. The panel includes a plurality of cleats spaced apart from one another. The storage container includes a first container portion, a second container portion, and a support feature removably engaging at least one cleat. A side of the second container portion is pivotably coupled to a side of the first container portion by a hinge. The second container portion and the first container portion are pivotably movable between a closed position and an open position. The support feature is positioned on at least one of the first container portion and the second container portion.

20 Claims, 32 Drawing Sheets

(56) References Cited

U.S. PATENT DOCUMENTS

| | | | |
|---|---|---|---|
| 2,695,105 | A | 11/1954 | Mitchell |
| 3,069,019 | A | 12/1962 | Schuster |
| 3,178,141 | A | 4/1965 | Bloom |
| 3,504,405 | A | 4/1970 | Cecily |
| 3,791,528 | A | 2/1974 | Brendgord |
| 3,860,309 | A | 1/1975 | Brendgord |
| 3,983,976 | A | 10/1976 | Taylor |
| 4,119,285 | A | 10/1978 | Bisping et al. |
| 4,228,906 | A | 10/1980 | Jones |
| 4,304,447 | A | 12/1981 | Ellwood et al. |
| 4,322,006 | A | 3/1982 | Marschak |
| 4,349,113 | A | 9/1982 | Schreiner |
| 4,413,736 | A | 11/1983 | Nibling |
| 4,552,272 | A | 11/1985 | Field |
| 4,793,496 | A | 12/1988 | Wait |
| 4,917,244 | A | 4/1990 | Sayers |
| 4,993,583 | A | 2/1991 | Chasen |
| 5,035,389 | A | 7/1991 | Wang |
| 5,071,095 | A | 12/1991 | Newby |
| 5,224,609 | A | 7/1993 | Bauer |
| 5,226,625 | A | 7/1993 | Hanna |
| 5,359,752 | A | 11/1994 | Domenig |
| 5,472,167 | A | 12/1995 | Shillington et al. |
| 5,503,277 | A | 4/1996 | O'Brien |
| 5,601,196 | A | 2/1997 | Heer et al. |
| 5,669,515 | A | 9/1997 | Tisbo et al. |
| 5,799,915 | A | 9/1998 | Morey |
| 5,947,322 | A | 9/1999 | Ho |
| 6,305,557 | B1 | 10/2001 | Brooks |
| 6,499,608 | B1 | 12/2002 | Sterling et al. |
| 6,564,949 | B1 | 5/2003 | Saathoff |
| 6,811,043 | B2 | 11/2004 | Perkins et al. |
| 6,926,160 | B2 | 8/2005 | Perkins et al. |
| 7,055,703 | B2 | 6/2006 | Perkins et al. |
| 7,097,063 | B2 | 8/2006 | Tucker et al. |
| 7,097,066 | B2 | 8/2006 | Tucker et al. |
| 7,147,115 | B2 | 12/2006 | Perkins et al. |
| 7,228,977 | B2 | 6/2007 | Perkins et al. |
| 7,296,695 | B2 | 11/2007 | Perkins et al. |
| 7,428,972 | B2 | 9/2008 | Warner et al. |
| D624,317 | S | 9/2010 | Wenchel et al. |
| 8,020,819 | B2 | 9/2011 | Crow et al. |
| 8,061,539 | B2 | 11/2011 | Punzel et al. |
| 8,191,845 | B1 | 6/2012 | Yu |
| 8,267,245 | B2 | 9/2012 | Kotula et al. |
| 8,505,729 | B2 | 8/2013 | Sosnovsky et al. |
| 8,534,623 | B2 | 9/2013 | Crow et al. |
| 8,573,415 | B2 | 11/2013 | Ernst et al. |
| 8,602,217 | B2 | 12/2013 | Sosnovsky et al. |
| 8,640,890 | B2 | 2/2014 | Schiller |
| 8,807,501 | B2 | 8/2014 | Chung et al. |
| 8,833,596 | B2 | 9/2014 | Sanguinet et al. |
| 8,875,888 | B2 | 11/2014 | Koenig et al. |
| 8,967,438 | B2 | 3/2015 | Russell et al. |
| 9,206,827 | B2 | 12/2015 | Loree et al. |
| 9,386,865 | B2 | 7/2016 | Bally |
| 9,389,012 | B2 | 7/2016 | Rackley et al. |
| 9,393,684 | B2 | 7/2016 | Christopher et al. |
| 9,398,819 | B2 | 7/2016 | Tsai et al. |
| 9,415,504 | B2 | 8/2016 | Chen |
| 9,676,518 | B2 | 6/2017 | Shamp et al. |
| 9,681,781 | B2 | 6/2017 | Hurley et al. |
| 9,874,393 | B2 | 1/2018 | Rackley et al. |
| 9,980,582 | B1 | 5/2018 | Levy et al. |
| RE47,022 | E | 9/2018 | Sosnovsky et al. |
| 10,138,032 | B2 | 11/2018 | Chang |
| 10,179,672 | B2 | 1/2019 | Kuhls et al. |
| 10,287,057 | B2 | 5/2019 | Nilsson et al. |
| 10,293,477 | B2 | 5/2019 | Wolle et al. |
| 10,413,092 | B2 | 9/2019 | Winnard |
| 10,492,631 | B2 | 12/2019 | Velderman et al. |
| 10,716,413 | B2 | 7/2020 | Winnard |
| 10,722,012 | B2 | 7/2020 | Kraus et al. |
| 10,925,412 | B2 | 2/2021 | Velderman et al. |
| 10,959,544 | B2 | 3/2021 | Winnard |
| 11,006,749 | B2 | 5/2021 | Anderson et al. |
| 11,014,716 | B2 | 5/2021 | Tyler et al. |
| 11,084,163 | B2 | 8/2021 | Strempke et al. |
| 11,155,382 | B1 * | 10/2021 | Cai ..... B65D 21/0223 |
| 2004/0108286 | A1 | 6/2004 | Coulson |
| 2004/0207298 | A1 | 10/2004 | Rodon et al. |
| 2005/0269276 | A1 | 12/2005 | Pfeiffer |
| 2007/0125731 | A1 | 6/2007 | Waterman |
| 2008/0000853 | A1 | 1/2008 | Huang |
| 2008/0006592 | A1 | 1/2008 | Brooks |
| 2008/0054142 | A1 | 3/2008 | Deland |
| 2008/0169739 | A1 | 7/2008 | Goldenberg |
| 2009/0134288 | A1 | 5/2009 | Kao |
| 2009/0145866 | A1 | 6/2009 | Panosian et al. |
| 2010/0117495 | A1 | 5/2010 | Cornell |
| 2011/0062295 | A1 | 3/2011 | Totman |
| 2011/0139777 | A1 | 6/2011 | Sosnovsky et al. |
| 2011/0234072 | A1 | 9/2011 | Hightower |
| 2012/0012726 | A1 | 1/2012 | Daniels |
| 2012/0074158 | A1 | 3/2012 | Lafleur |
| 2012/0228300 | A1 | 9/2012 | Wertman |
| 2012/0267374 | A1 | 10/2012 | Kotula et al. |
| 2013/0047386 | A1 | 2/2013 | Barfoot et al. |
| 2014/0263119 | A1 | 9/2014 | Gruger et al. |
| 2015/0329251 | A1 | 11/2015 | Sanguinet et al. |
| 2016/0066710 | A1 | 3/2016 | Bally |
| 2017/0274522 | A1 | 9/2017 | Kao |
| 2018/0080603 | A1 | 3/2018 | Ho et al. |
| 2018/0220758 | A1 | 8/2018 | Burchia |
| 2019/0106244 | A1 * | 4/2019 | Brunner ..... B25H 3/021 |
| 2019/0168376 | A1 | 6/2019 | Brocket et al. |
| 2019/0225371 | A1 | 7/2019 | Hoppe et al. |
| 2020/0118065 | A1 | 4/2020 | Li et al. |
| 2020/0299504 | A1 | 9/2020 | Munoz |
| 2021/0112998 | A1 | 4/2021 | Gargano |
| 2021/0127855 | A1 | 5/2021 | Velderman et al. |
| 2021/0147113 | A1 | 5/2021 | Workman |
| 2021/0155373 | A1 | 5/2021 | Cai |
| 2021/0245359 | A1 | 8/2021 | Hohl et al. |
| 2021/0245360 | A1 | 8/2021 | Hohl |
| 2021/0252690 | A1 | 8/2021 | Strempke et al. |

FOREIGN PATENT DOCUMENTS

| | | | |
|---|---|---|---|
| AU | 2020203900 | A1 | 7/2020 |
| AU | 2019283962 | A1 | 8/2021 |
| CH | 689863 | A5 | 12/1999 |
| CN | 203228220 | U | 10/2013 |
| CN | 203427004 | U | 2/2014 |
| CN | 203427005 | U | 2/2014 |
| CN | 203919013 | U | 11/2014 |
| CN | 204819447 | U | 12/2015 |
| CN | 205766046 | U | 12/2016 |
| CN | 205799447 | U | 12/2016 |
| CN | 205950695 | U | 2/2017 |
| CN | 206185841 | U | 5/2017 |
| CN | 109602255 | A | 4/2019 |
| CN | 210064056 | U | 2/2020 |
| CN | 210307728 | U | 4/2020 |
| CN | 210335895 | U | 4/2020 |
| CN | 211392067 | U | 9/2020 |
| CN | 211392068 | U | 9/2020 |
| CN | 211615552 | U | 10/2020 |
| CN | 211639851 | U | 10/2020 |
| CN | 212399523 | U | 1/2021 |
| CN | 212763410 | U | 3/2021 |
| CN | 213562493 | U | 6/2021 |
| CN | 113071811 | A | 7/2021 |
| CN | 213616623 | U | 7/2021 |
| CN | 213703360 | U | 7/2021 |
| DE | 2334362 | B1 | 9/1974 |
| DE | 3823142 | A1 | 1/1990 |
| DE | 9206394 | U1 | 7/1992 |
| DE | 20314773 | U1 | 12/2003 |
| DE | 202004016510 | U1 | 1/2005 |
| DE | 202008013258 | U1 | 1/2009 |
| DE | 202013005194 | U1 | 6/2013 |
| DE | 202014009931 | U1 | 3/2015 |
| DE | 102014111337 | A1 | 10/2015 |

(56) References Cited

FOREIGN PATENT DOCUMENTS

| | | | | |
|---|---|---|---|---|
| DE | 102011110636 | B4 | 1/2017 | |
| DE | 202016103774 | U1 | 10/2017 | |
| DE | 102016218116 | A1 | 3/2018 | |
| DE | 202019104499 | U1 | 9/2019 | |
| DE | 202019105716 | U1 | 12/2019 | |
| DE | 102018214160 | A1 | 2/2020 | |
| DE | 102018214925 | A1 | 3/2020 | |
| DE | 102020200963 | A1 | 7/2021 | |
| DE | 202021102543 | U1 | 7/2021 | |
| DE | 102020205607 | A1 | 11/2021 | |
| EP | 3067160 | A1 | 9/2016 | |
| EP | 3159115 | A2 * | 4/2017 | ..... B25H 3/02 |
| EP | 3593955 | A1 * | 1/2020 | ..... A47F 5/08 |
| GB | 2486262 | A | 6/2012 | |
| GB | 2582851 | A | 10/2020 | |
| GB | 2585747 | A | 1/2021 | |
| TW | I517946 | B | 1/2016 | |
| TW | I639491 | B | 11/2018 | |
| WO | WO2010084309 | A1 | 7/2010 | |
| WO | WO2014072682 | A1 | 5/2014 | |
| WO | WO2020052783 | A1 | 3/2020 | |
| WO | WO2021000525 | A1 | 1/2021 | |
| WO | WO2021002756 | A1 | 1/2021 | |
| WO | WO2021108890 | A1 | 6/2021 | |

OTHER PUBLICATIONS

European Search Report Corresponding with Application No. EP22184245 on Apr. 21, 2023 (2 pages).

* cited by examiner

STORAGE SYSTEM AND CONTAINER FOR SAME

CROSS-REFERENCE TO RELATED APPLICATIONS

The present application claims the benefit of U.S. Provisional Patent Application No. 63/220,801, filed Jul. 12, 2021, and U.S. Provisional Patent Application No. 63/302,934, filed Jan. 25, 2022. The entire contents of these applications are incorporated by reference.

BACKGROUND

The present disclosure relates to storage systems, and more particularly to wall mounted storage containers for tool accessories and the like.

Hand tools, power tools, and associated accessories such as batteries, tool bits, sockets, accessories, fasteners, and the like, may be moved frequently between a storage space and a work space. One aspect of accessibility is a user's ability to quickly store an object and remove the object from storage. Another aspect of accessibility is the storage system's ability to engage many objects with a standardized connection mechanism between the system and the object. This may also permit an object to engage the storage system at a plurality of locations. Storage systems may also be accessible for extension or expansion. Finally, storage systems are accessible when located adjacent a work space.

SUMMARY

In one independent aspect, a storage container includes a first container portion including a first side and a second side; a second container portion including a third side and a fourth side, and a support feature configured to engage a wall support system. The third side is pivotably coupled to the first side of the first container portion by a hinge. The second container portion and the first container portion are pivotably movable between a closed position and an open position. The fourth side and the second side are adjacent one another in the closed position, and the fourth side and the second side are spaced apart from one another in the open position. The support feature positioned on at least one of the first container portion and the second container portion In another independent aspect, a storage system includes a panel secured to a support surface and a storage container removably supported on the panel. The panel includes a plurality of cleats spaced apart from one another. The storage container includes a first container portion, a second container portion, and a support feature removably engaging at least one cleat. The first container portion includes a first side and a second side. The second container portion includes a third side and a fourth side. The third side is pivotably coupled to the first side of the first container portion by a hinge. The second container portion and the first container portion are pivotably movable between a closed position and an open position. The fourth side and the second side are adjacent one another in the closed position, and the fourth side and the second side are spaced apart from one another in the open position. The support feature is positioned on at least one of the first container portion and the second container portion.

In yet another independent aspect, a storage container includes a first container portion, a second container portion, a hinge coupling a first side of the first container portion and a second side of the second container portion for pivoting movement about a pivot axis, a latch releasably securing the first container portion and the second container portion in the closed position, and a support feature configured to engage a wall support system. The first container portion and the second container portion are pivotably movable between a closed position and an open position. The support feature includes a first partial mounting portion positioned on the first container portion and a second partial mounting portion positioned on the second container portion. The first partial mounting portion and the second partial mounting portion form a full mounting portion while the first container portion and the second container portion are in the closed position. The first partial mounting portion and the second partial mounting portion are configured to engage the wall support system.

Other aspects of the disclosure will become apparent by consideration of the detailed description and accompanying drawings.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limited. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, whether direct or indirect. Terms of degree, such as "substantially," "about," "approximately," etc. are understood by those of ordinary skill to refer to reasonable ranges outside of the given value, for example, general tolerances associated with manufacturing, assembly, and use of the described embodiments.

DETAILED DESCRIPTION

Figure 1:
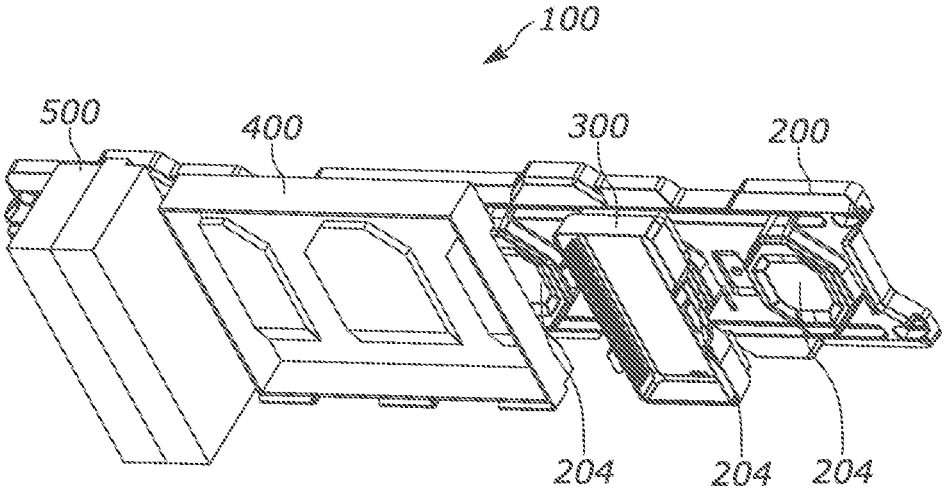
FIG. 1 is a perspective view of a storage system including a support panel and three containers.
Figure 2:
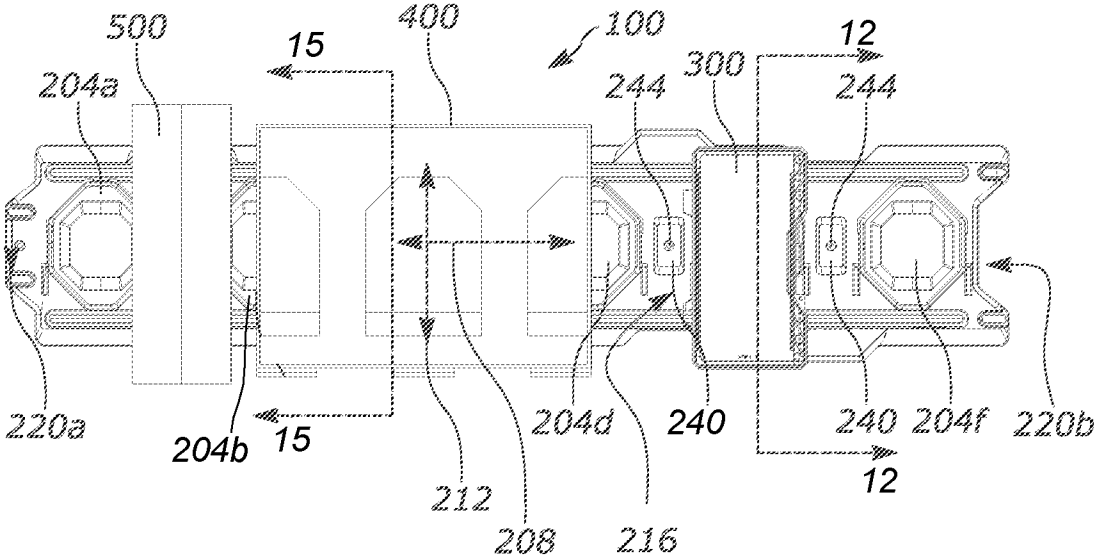
FIG. 2 is a front view of the storage system of FIG. 1.
Figure 3:
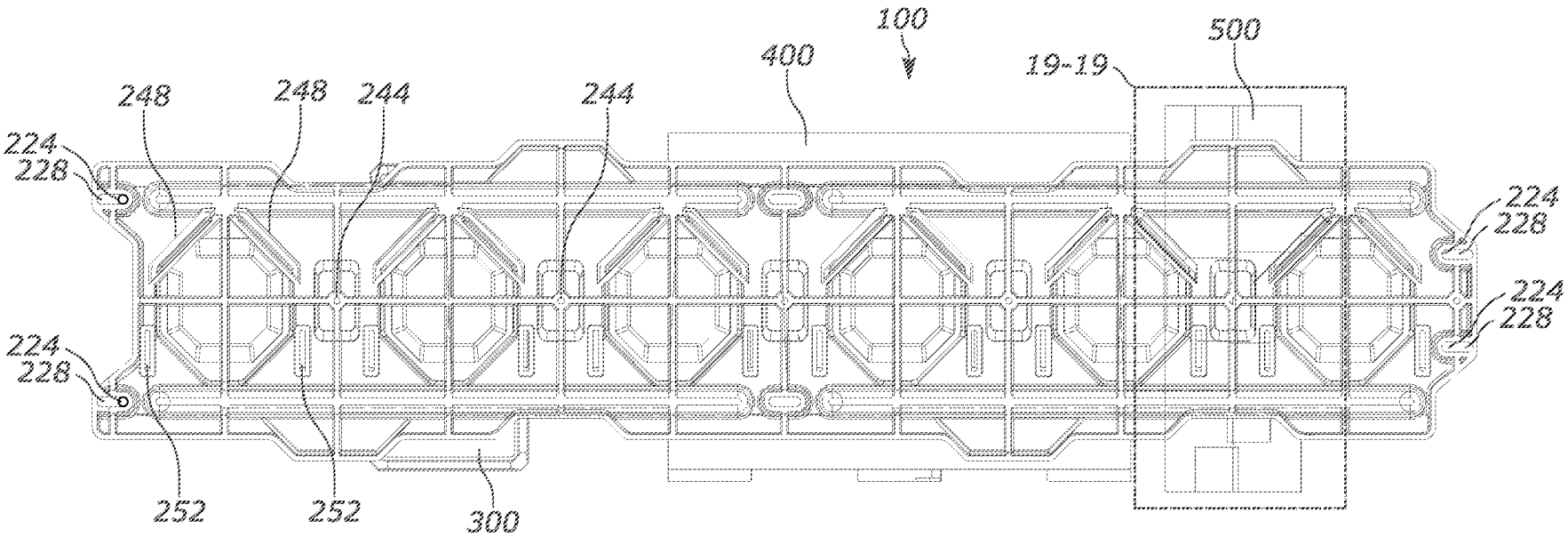
FIG. 3 is a rear view of the storage system of FIG. 1.

FIGS. 1-3 illustrate a storage system 100 including a support panel (e.g., a rail 200), a first container 300, a second container 400, and a third container 500. The rail 200 includes cleats 204. Each of the first container 300, the second container 400, and the third container 500 are independently removable from the cleats 204 of the rail 200.

As illustrated in FIG. 2, the rail 200 includes a plurality of cleats 204 which are generally aligned and spaced apart along a longitudinal axis 208 of the rail 200. In the illustrated embodiment, the cleats 204 have a generally octagonal shape. Stated another way, each cleat 204 has four angled edges that substantially form a diamond shape. In other embodiments, the cleat 204 may have another shape (e.g., hexagonal, rectangular), and/or may have two angled edges. The cleats 204 protrude along an axis 212 which is perpendicular to the longitudinal axis 208. In the illustrated embodiment, the rail 200 includes a single row of cleats 204 aligned in a horizontal direction (e.g., along the longitudinal axis 208 of the rail 200); in other embodiments, the panel may have fewer or more cleats, and/or may have multiple rows of cleats.

Figure 4:
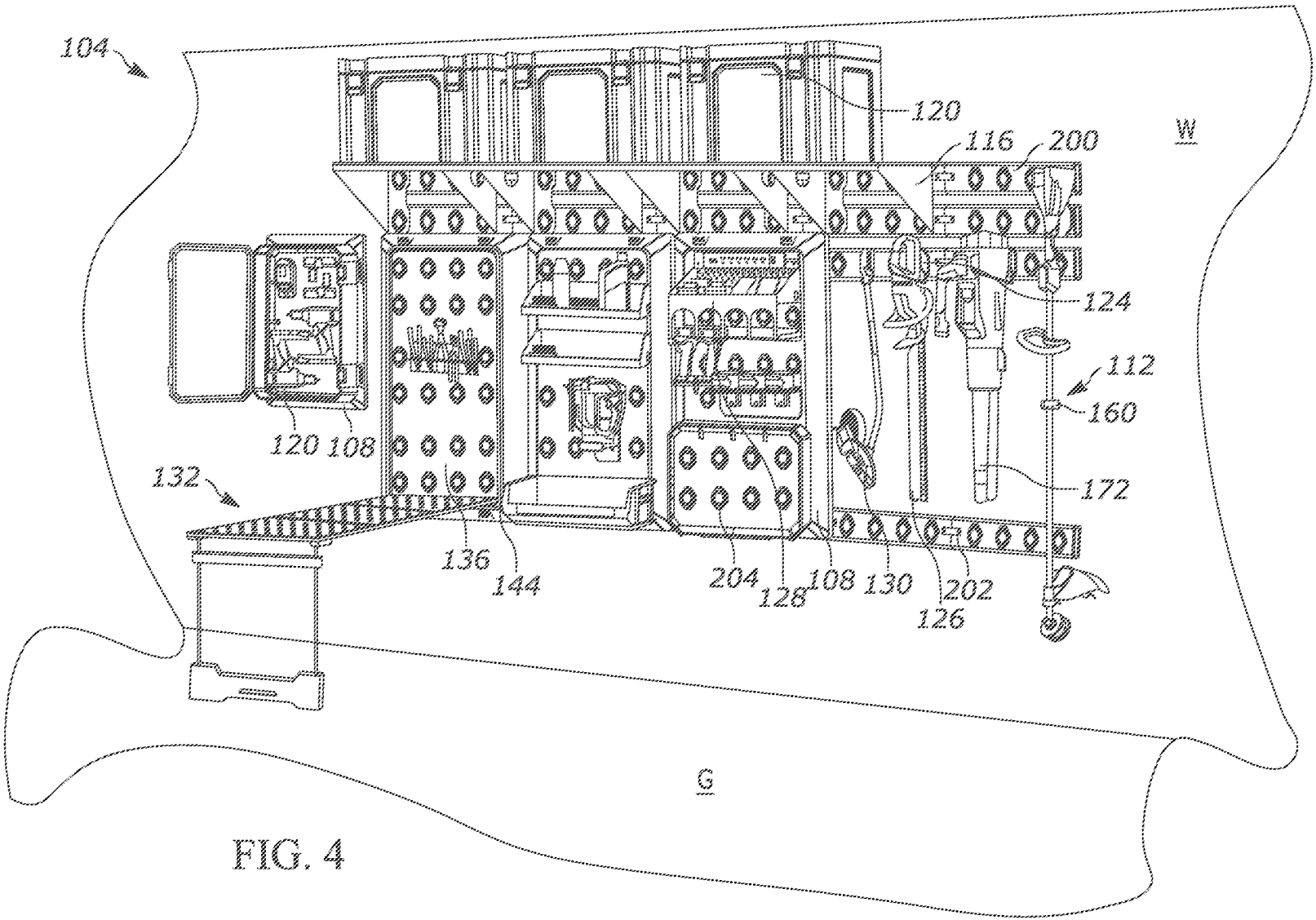
FIG. 4 is a perspective view of an organization system.
Figure 7:
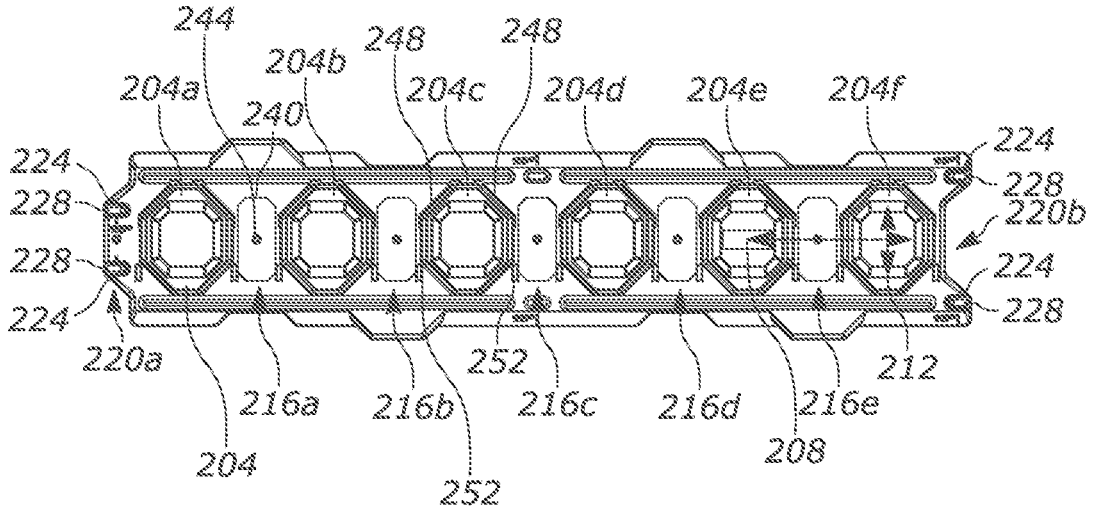
FIG. 7 is a front view of the support panel of FIG. 1.

For example, as shown in FIG. 4, an organization system 104 may include the rail 200 as well as other mounting or support structures. The organization system 104 may be compatible with the described storage system 100, and the containers 300, 400, 500 may attach to cleats 204 of the organization system 104. The organization system 104 may include multiple rails 200 as well as one or more larger panels 108 supported on a support surface or wall W and including one or more cleats 204. Each rail 200 may be separately secured to the wall W by one or more fasteners 224 (FIG. 7). Adjacent rails 200 may be attached to each other (e.g., by one or more rail extensions 156). In some embodiments, the cleats 204 of adjacent rails 200 are spaced with the same spacing along the longitudinal axis 208 as adjacent cleats 204 of a single rail 200.

Each cleat 204 may be configured to engage and support various types of objects 112 including, but not limited to, shelves 116, storage boxes 120, hanging attachments 124, tool holders 128, workbenches 132, tools, and the like. Each object 112 has a mount portion having a shape that corresponds to and receives the cleat 204. The engagement between the cleat 204 and the object 112 may be a locking engagement, or a gravitational engagement similar to a French cleat. As such, the objects 112 can be attached to the support surface (e.g., a wall W). The objects 112 illustrated in FIG. 4 include a string trimmer 160, a blower 172, a hedge trimmer 164, an edger 168, and the workbench 132. Other objects 112 are capable of being supported on the rail 200. As previously discussed, the hanging attachment 124 may engage the cleat 204. Various hanging attachments 124 can serve as an intermediate between any given object 112 and the rail 200. The hanging attachment 124 may include, but is not limited to, fixed "U", "T", "J" or otherwise shaped brackets, hinges, or other fixed or movable components to enhance a user's ability to quickly support or remove the object 112 from the rail 200. The storage boxes 120 can be stackable containers and may include an engagement interface and/or locking mechanism for securing the box 120 to the rail 200 or panels 108. The boxes 120 and the containers 300, 400, 500 may be secured to cleats 204 by, for example, mounting portions described below.

FIGS. 5-8 illustrate the rail 200 in detail. As previously mentioned, the rail 200 includes a plurality of cleats 204*a*-204*f* spaced along the longitudinal axis 208 of the rail 200. Between each of the cleats 204*a*-204*f* is a gap or space 216*a*-216*e*. Other hanging attachments (not shown) may be located within the gaps 216*a*-216*e* to engage adjacent cleats 204 to secure objects 112 to the rail 200. In the illustrated embodiment, partial gaps 220*a*, 220*b* are located at longitudinal ends of the rail 200 beyond the outermost cleats 204*a*, 204*f*.

With reference to FIG. 7, the rail 200 is secured to the wall W by a plurality of support fasteners 224. The support fasteners 224 extend through fastener slots 228 of the rail 200. As illustrated in FIG. 7, the fastener slots 228 may be laterally offset from the cleats 204 (i.e., the slots 228 are axially spaced apart from the cleats along the longitudinal axis 208). As illustrated in FIG. 7, the fastener slots 228 are also offset from the axis 212 of the cleats 204. This position of the fastener slots 228 may promote access to the support fasteners 224 while the containers 300, 400, 500 are attached to the rail 200. In other embodiments, the fastener slots 228 may be located in other positions.

As illustrated in FIGS. 5-8, the outer periphery of the rail 200 includes a plurality of male mating features 232 and a plurality of female mating features 236 which may engage complementary features of one or more adjacent rails 200.

Figure 8:
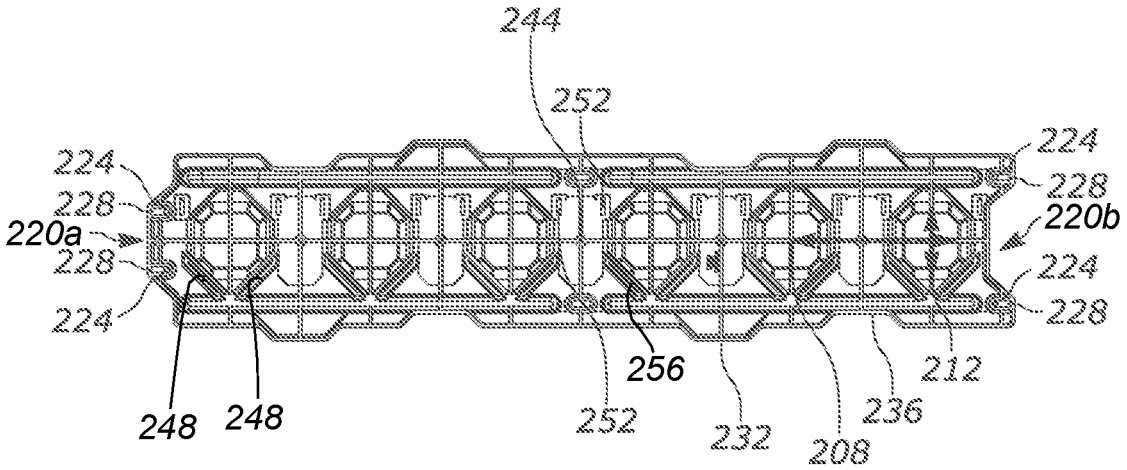
FIG. 8 is a rear view of the support panel of FIG. 1.

As best viewed in FIG. 8, the rail 200 further includes angled slots 248 and vertical slots 252. In some embodiments, the angled slots 248 and vertical slots 252 pass entirely through the rail 200. The angled slots 248 and vertical slots 252 may be used to secure other hanging attachments 124 or the containers 300, 400, 500.

Figure 5:
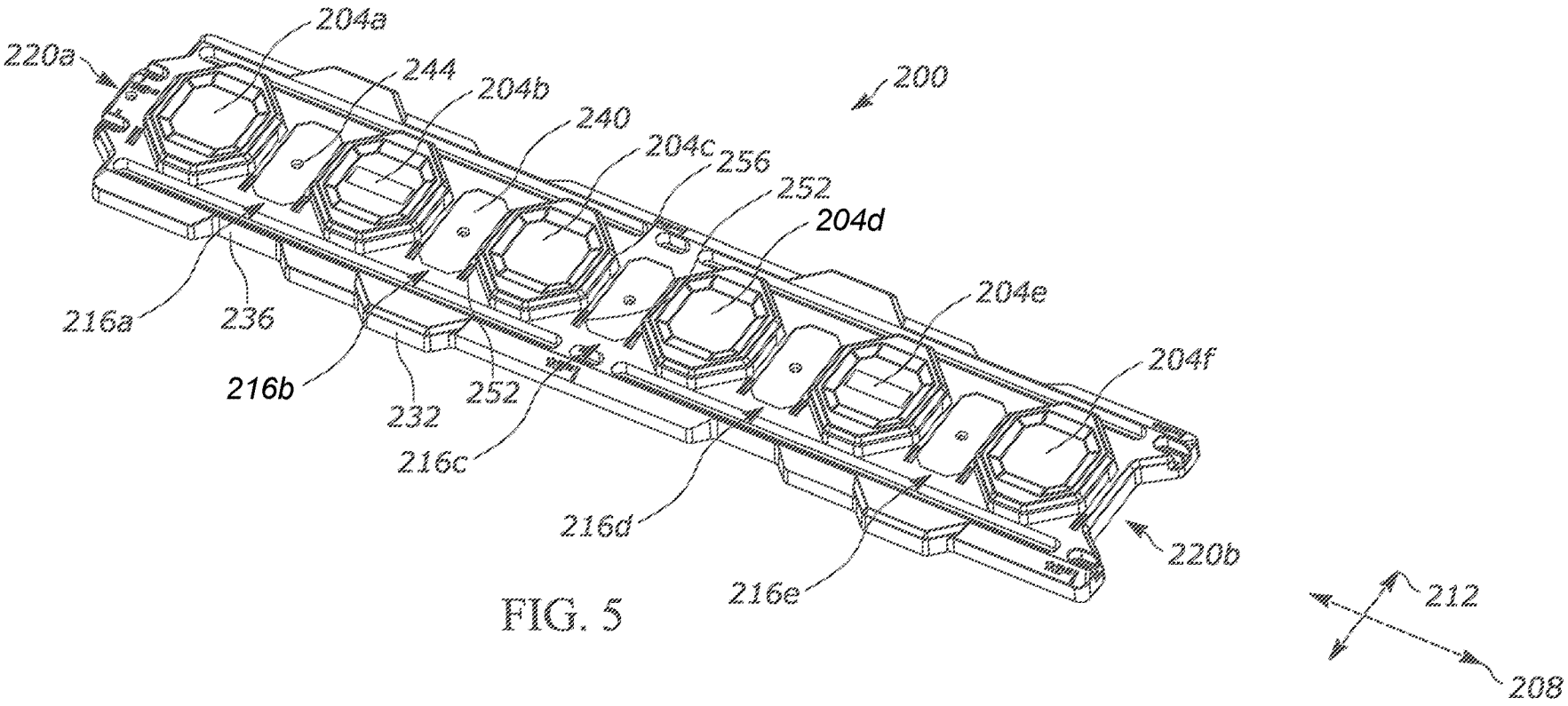
FIG. 5 is a perspective view of the support panel of FIG. 1.
Figure 6:
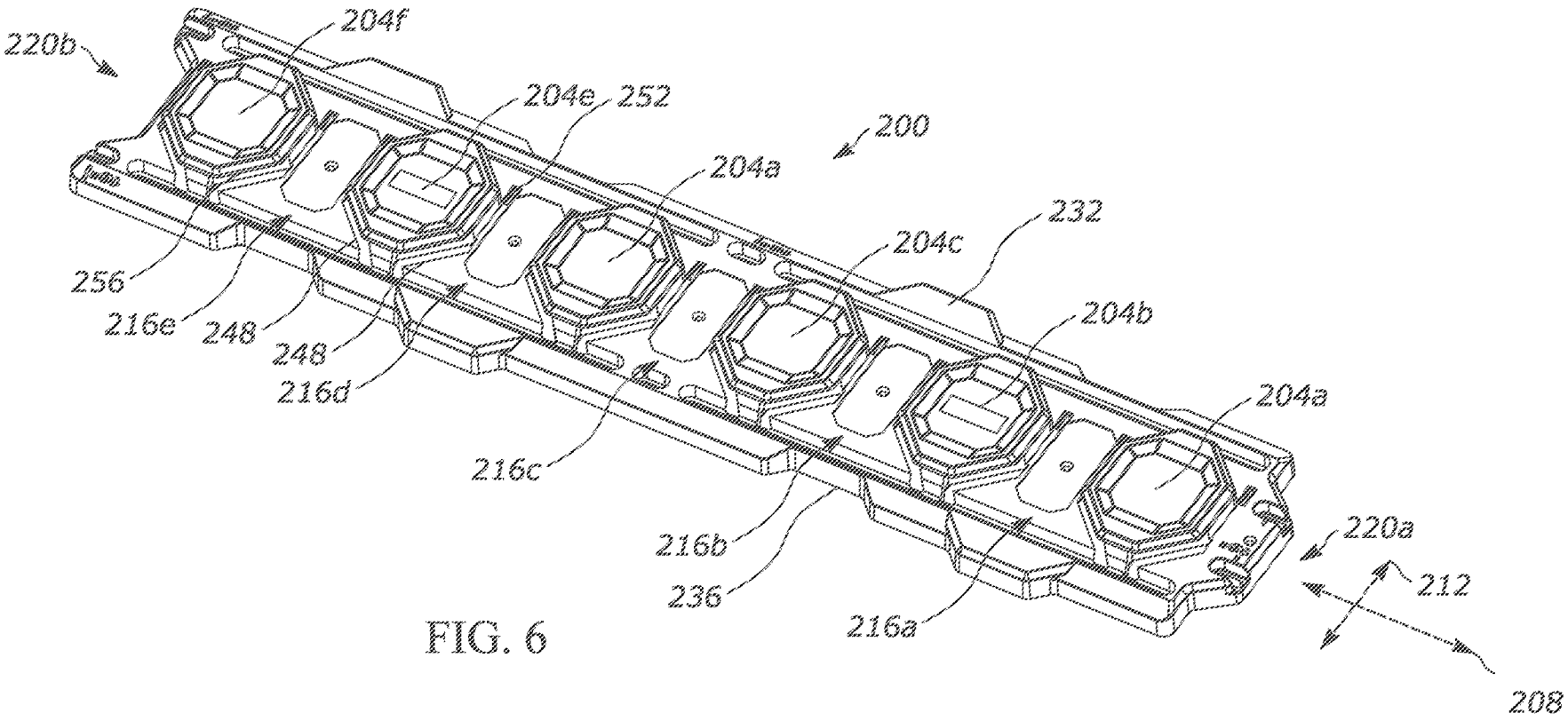
FIG. 6 is another perspective view of the support panel of FIG. 1.

As best viewed in FIGS. 5 and 6, each cleat 204 projects away from the rail 200 in a direction away from the wall W. Portions of the cleats 204 may include cleat lips 256 which are configured to engage and secure the containers 300, 400, 500 or the hanging attachment 124 to the rail 200. In the illustrated embodiment, cleat lips 256 are applied to portions of each cleat 204 adjacent to upper portions (i.e., in a vertical orientation) of the rail 200 furthest from the ground G.

Figure 9:
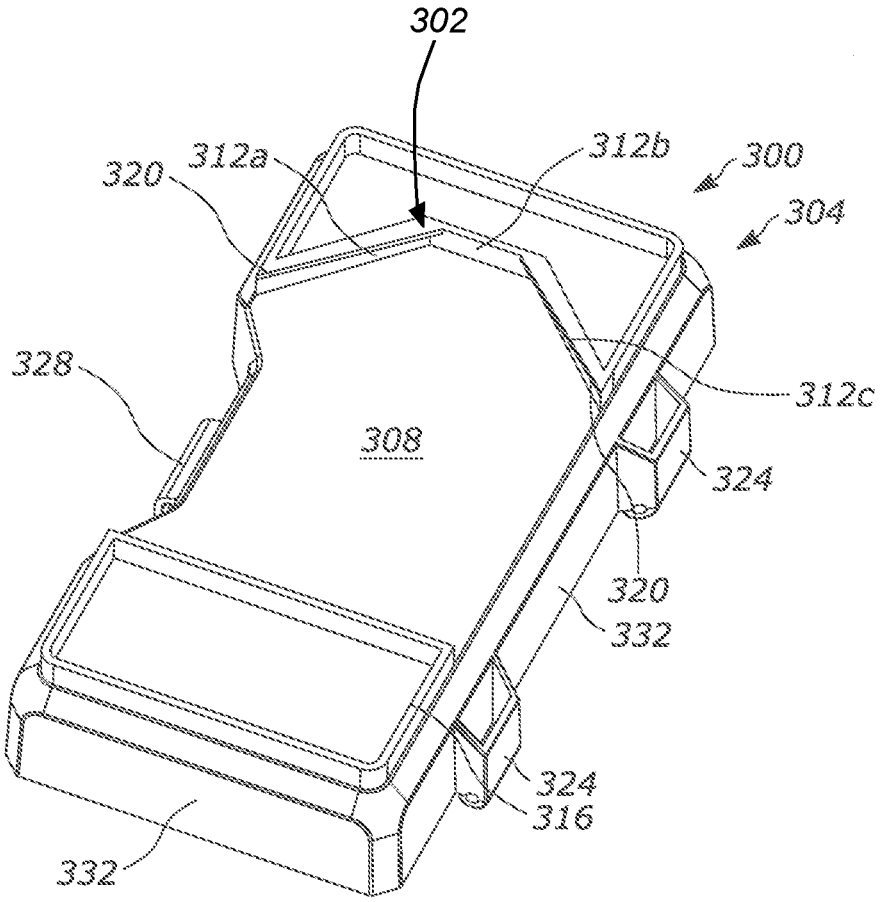
FIG. 9 is a rear perspective view of a first container.
Figure 11:
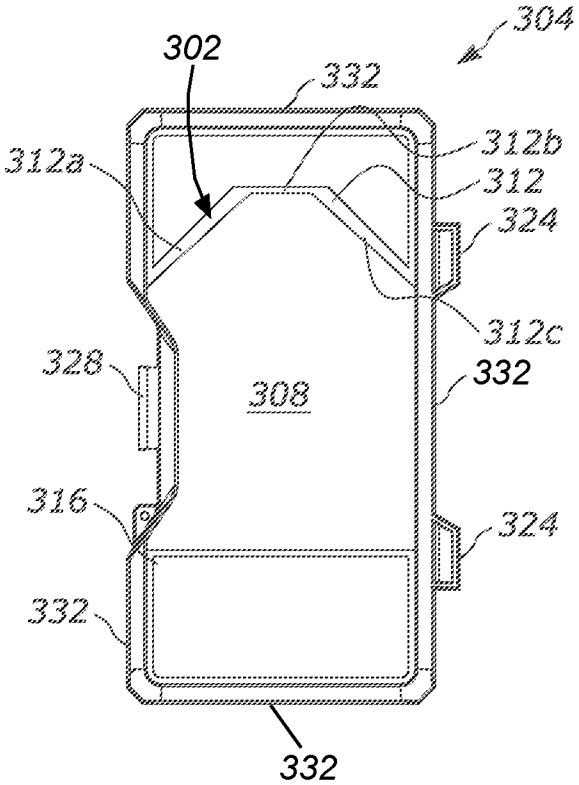
FIG. 11 is a rear view of the first container of FIG. 9.
Figure 10:
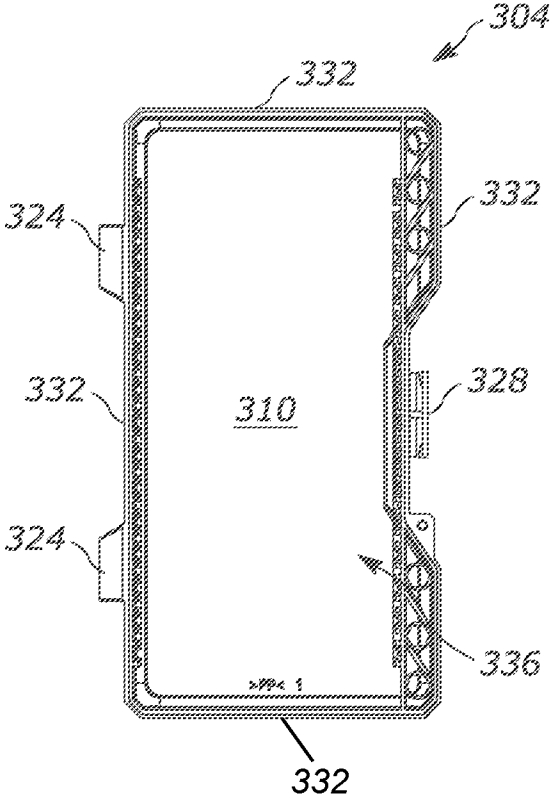
FIG. 10 is a front view of the first container of FIG. 9.

As shown in FIGS. 9-11, the first container 300 includes a first portion 304 and a second portion (not shown). In the illustrated embodiment, the first container 300 is a clamshell-type container having a first clamshell half and a second clamshell half. The container 300 may also include a closure mechanism or latch (not shown) for releasably securing the first clamshell half 304 and the second clamshell half in a closed position. A support feature 302 is positioned on the container 300 and is configured to engage a structure (e.g., a wall support member such as a cleat) and support the container 300 relative to the structure. The support feature may have various forms, some of which are shown or described herein. As illustrated in FIG. 9, for example, the container 300 includes a rear surface 308, and the support feature 302 includes an angled projection 312 and a straight projection 316 are positioned on the rear surface 308. A front surface 310 (FIG. 10) opposes the rear surface 308. As illustrated in FIG. 9, the angled projection 312 includes a first portion 312*a* that is angled relative to the longitudinal axis 208. The angled projection 312 includes a second portion 312*b* that is parallel relative to the longitudinal axis 208. The angled projection 312 also includes a third portion 312*c* that is non-parallel relative to the longitudinal axis 208. The shape of the angled projection 312 generally corresponds with the shape of the cleat 204. Each of the portions 312*a*, 312*c* includes an associated edge 320. The edge 320 is dimensioned to engage the cleat lip 256. In other words, the edge 320 provides a mounting interface. In the illustrated embodiment, the edge 320 is a lip that engages the cleat lip 256 in a complementary manner.

FIG. 10 illustrates the front surface 310. The container 300 further includes a hinge, which in the illustrated embodiment includes a hinge having lugs 324 securing the first clamshell half 304 to the second clamshell half (not shown). The container 300 includes sidewalls 332 which extend from the front surface 310 to define a gap or space 336. Accessories, sockets, tool bits, or other components may be stored within the gap 336.

Figure 12:
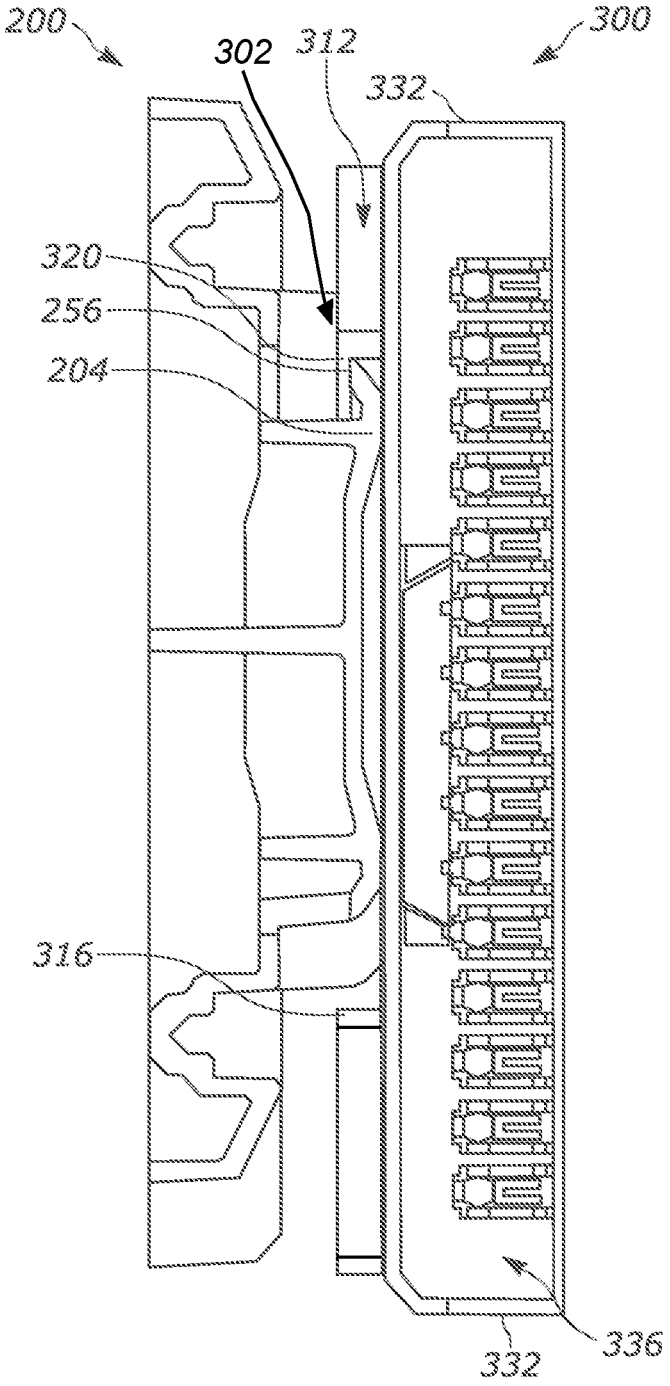
FIG. 12 is a cross-sectional view of the support panel and first container viewed along section 12-12 in FIG. 2.

FIG. 12 illustrates the connection between the rail 200 and the container 300. The container 300 may be translated along the axis 212 such that the edge 320 of the container 300 engages the cleat lip 256. Optionally, the container 300 is snap-fit with the cleat 204 with the edge 320 and the cleat lip 256. Optionally, the straight projection 316 may abut the cleat 204.

Figure 13:
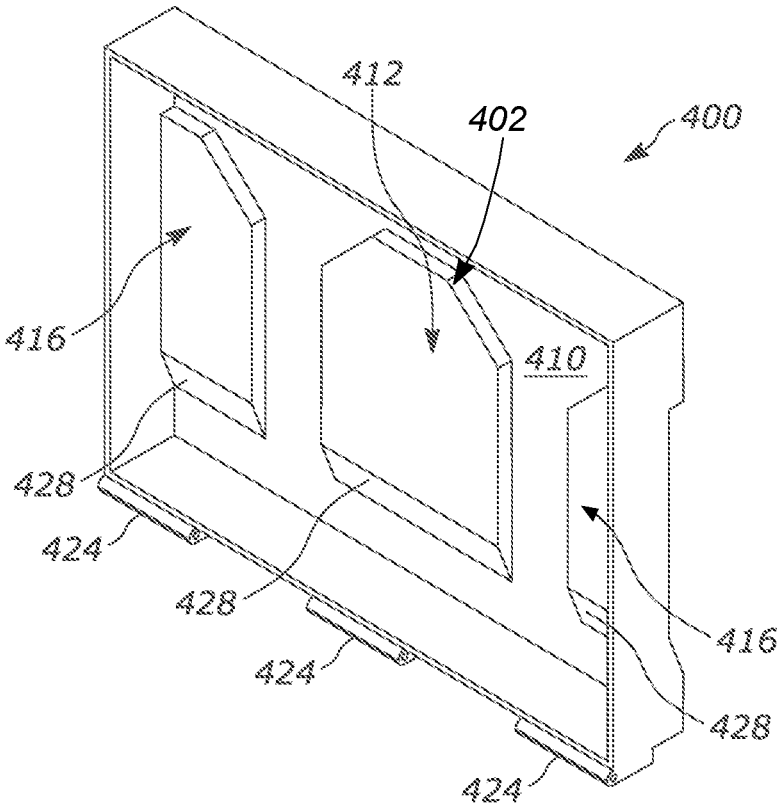
FIG. 13 is a front perspective view of a second container.
Figure 14:
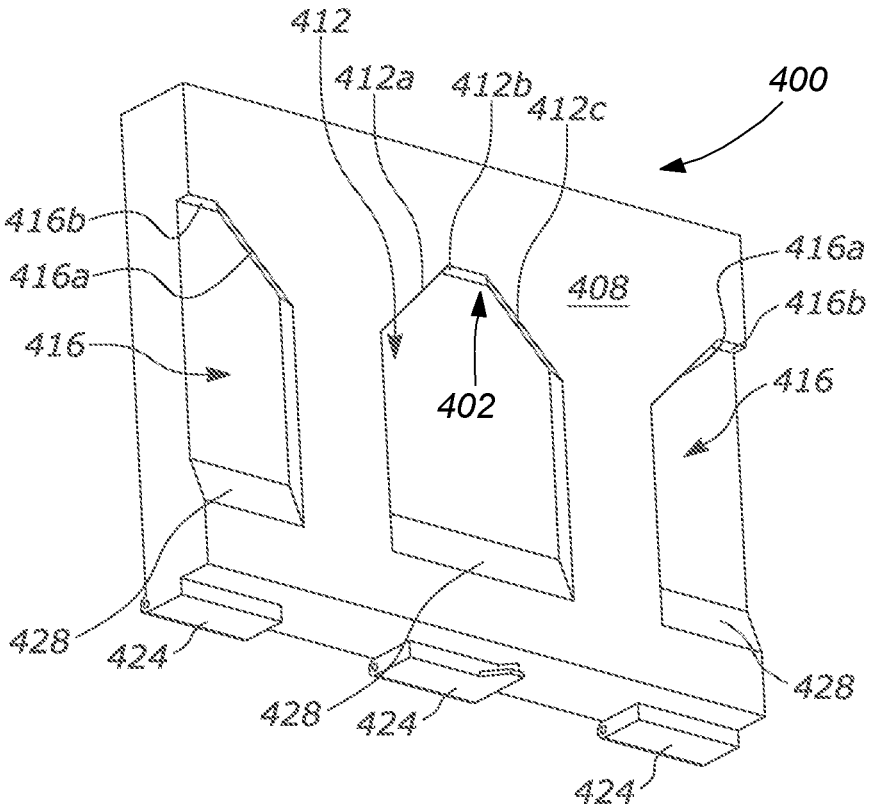
FIG. 14 is a rear perspective view of the second container of FIG. 13.

As shown in FIGS. 13-14, the second container 400 includes a first clamshell half 404 and may further include a second clamshell half (not shown). The container 400 may also include a closure mechanism or latch (not shown) for releasably securing the first clamshell half 404 and the second clamshell half in a closed position. The clamshell half 404 includes a rear surface 408 (FIG. 14), and a front surface 410 (FIG. 13) opposite the rear surface 408. A support feature 402 is positioned on the container 400 and is configured to engage a structure (e.g., a wall support member such as a cleat) and support the container 400 relative to the structure. The support feature may have various forms, some of which are shown or described herein. For example, as shown in FIG. 14, the support feature 402 may take the form of an indented portion 412 that is formed on the clamshell half 404 and is indented inwardly from the rear surface 408. The indented portion 412 includes a first angled portion 412*a* oriented at an angle relative to the longitudinal axis 208, a second straight portion 412*b* oriented parallel to the longitudinal axis 208 and a third angled portion 412*c* oriented at an angle relative to the longitudinal axis 208. The clamshell half 404 further includes two partial indented portions 416 which flank the indented portion 412. The partial indented portions 416 extend to longitudinal sides of the container 400.

In the storage system 100, as viewed in FIGS. 2 and 3, the indented portion 412 engages the cleat 204*c* and the partial indented portions 416 engage, respectively, at least a portion of the cleats 204*b* and 204*c*. In other mounting arrangements of the second container 400, the partial indented portions 416 engage, respectively, at least a portion of the cleat 204 of an adjacent rail 200. The first angled portion 412*a* and the third angled portion 412*c* are each provided with an edge 420. Each edge 420 is dimensioned to engage a lip 256 of one of the cleats. In other words, the edge 420 provides a mounting interface. In the illustrated embodiment, the edge 420 is a lip that engages the lip 256 in a complementary manner. The first clamshell half 404 of the container 400 further includes hinge knuckles or lugs 424. The hinge lugs 424 may secure the first clamshell half 404 to the second clamshell half (not shown). The clamshell half 404 further includes a ramp 428 that is angled between the front surface 410 and the indented portion 412. Ramps 428 may also be provided on the partial indented portions 416. The container 400 includes sidewalls 432 extending from the front surface 410 to define a gap or space 436. Accessories, sockets, tool bits, or other components may be stored within the gap 436.

Figure 15:
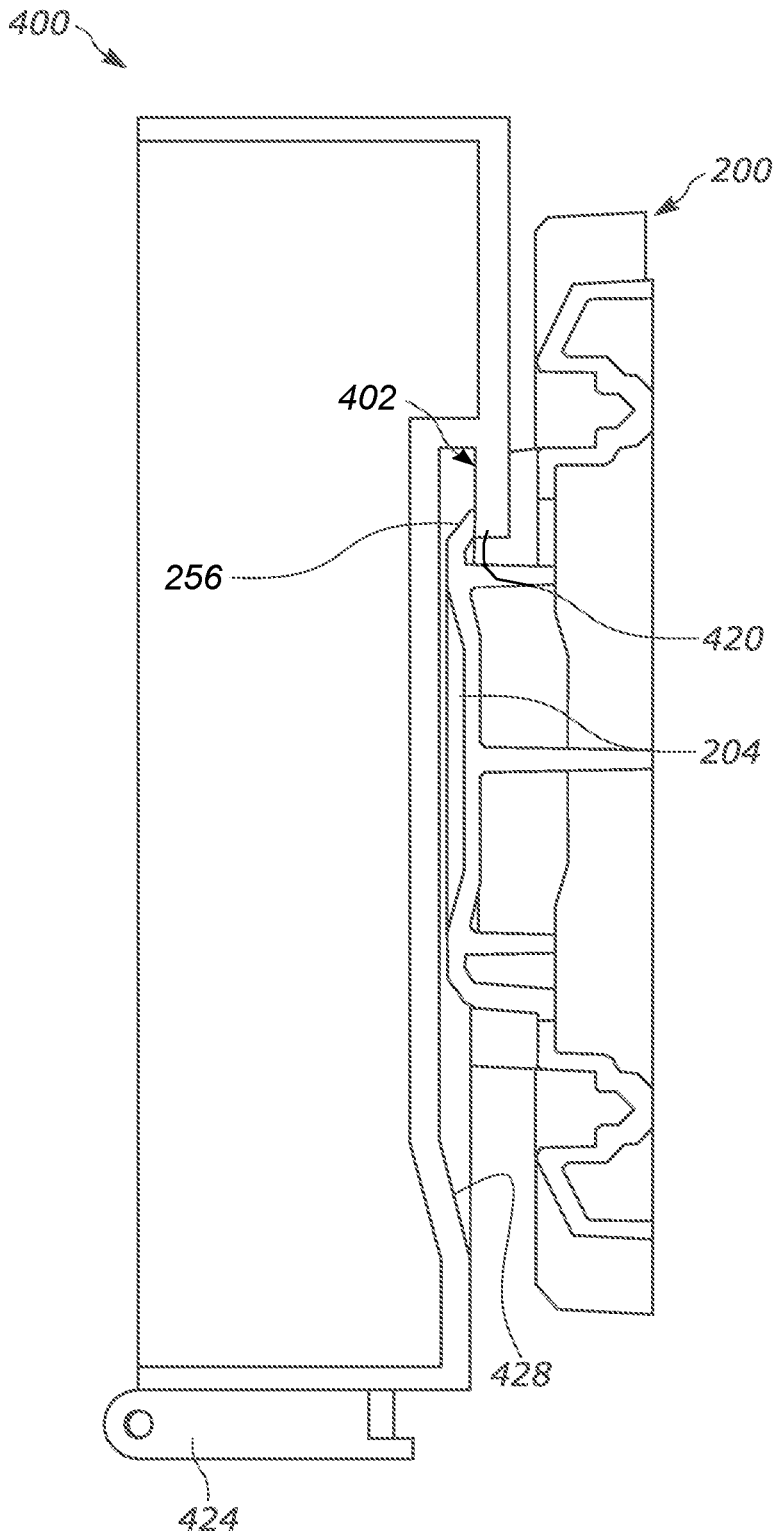
FIG. 15 is a cross-sectional view of the support panel and the second container, viewed along section 15-15 in FIG. 2.

FIG. 15 illustrates the connection between the rail 200 and the container 400. The container 400 may be translated along the transverse axis 212 such that the edge 420 of the container 400 engages the cleat lip 256. During translation along the axis 212, the ramp 428 may contact a surface of the cleat 204. Optionally, the container 400 is snap-fit with the edge 420 and the cleat lip 256.

Figure 17:
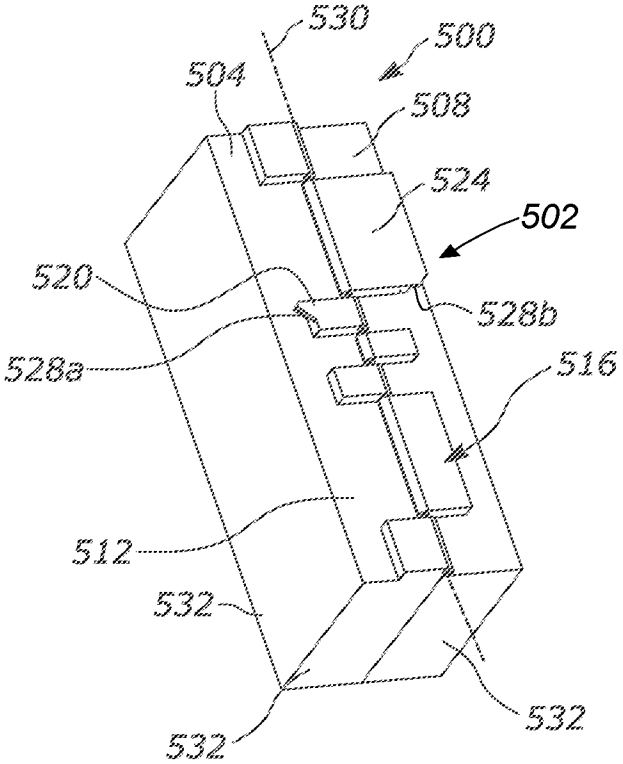
FIG. 17 is a rear perspective view of the third container of FIG. 16.
Figure 16:
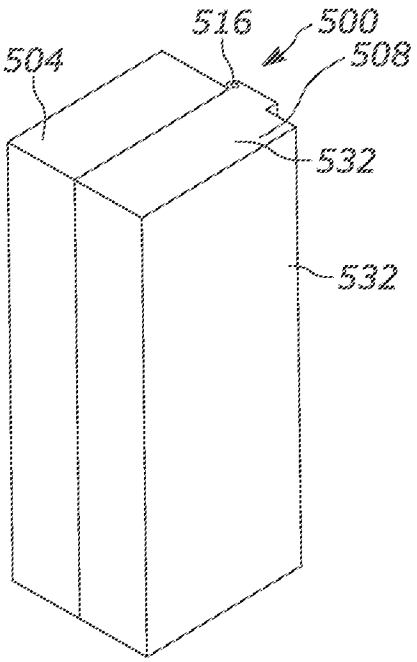
FIG. 16 is a front perspective view of a third container.

FIGS. 16-19 illustrate the third container 500. The container 500 includes a first clamshell half 504 and a second clamshell half 508. The container 500 may also include a closure mechanism or latch (not shown) for releasably securing the first clamshell half 504 and the second clamshell half 508 in a closed position. As illustrated in FIG. 17, the container 500 includes a rear surface 512 which is configured to face the rail 200 and the cleat 204. A hinge 516 may be supported on the rear surface 512 to pivotably couple the first clamshell half 504 to the second clamshell half 508. A support feature 502 is positioned on the container 500 and is configured to engage a structure (e.g., a wall support member such as a cleat) and support the container 500 relative to the structure. The support feature may have various forms, some of which are shown or described herein. For example, in the illustrated embodiment, the support feature 502 may include a first attachment portion 520 positioned on a first clamshell half 504, and a second attachment portion 524 positioned on the second clamshell half 508. The first attachment portion 520 may extend at least partially along a width of the first clamshell half 504, and the second attachment portion 524 may extend a full distance along a width of the second clamshell half 508. The remainder of the hinge mechanism 516 is provided by hinge lugs that extend a partial distance along a width of either the first clamshell half 504 or the second clamshell half 508. The hinge lugs of the first clamshell half 504 are complementary to the second clamshell half 508, permitting the hinge lugs to intermesh with one another when the clamshell halves 504, 508 are completely opened.

Figure 18:
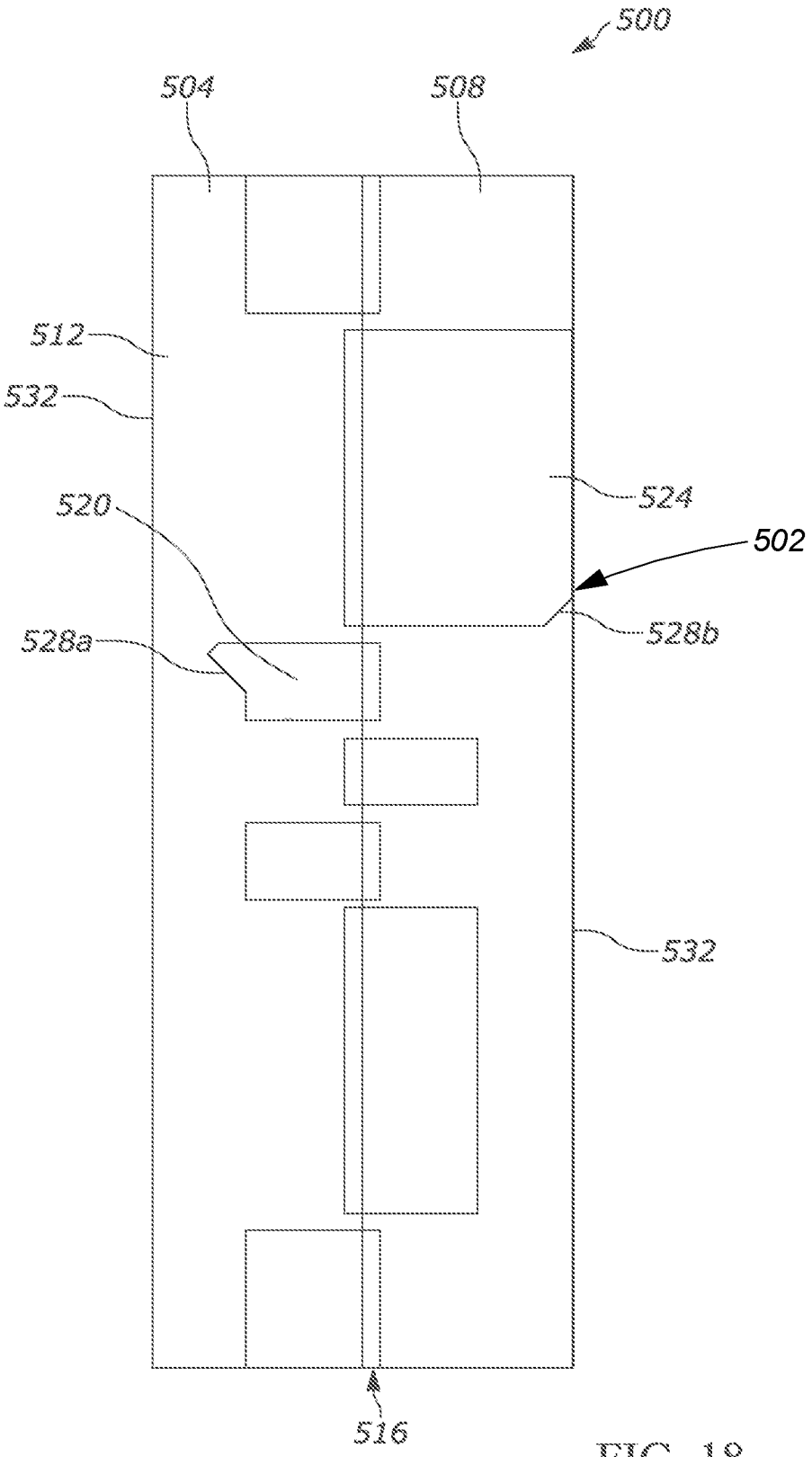
FIG. 18 is a rear view of the third container of FIG. 16.
Figure 19:
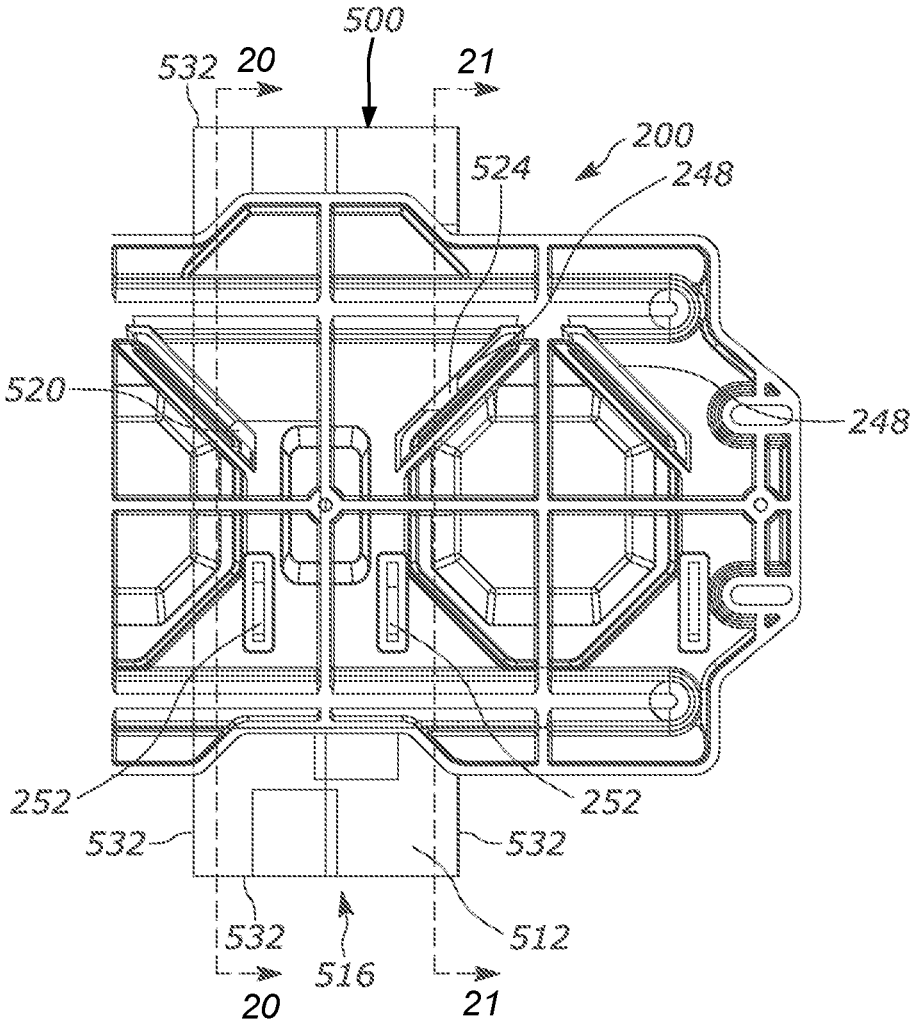
FIG. 19 is an enlarged sectional view of the support panel and the third container viewed along section 19-19 in FIG. 3.

As best illustrated in FIGS. 17-19, the first attachment portion 520 includes an edge 528*a* and the second attachment portion 524 includes an edge 528*b*. The edges 528*a*, 528*b* are oriented at an angle (i.e., non-parallel) to an axis 530 of the hinge 516, and the angle substantially corresponds with the angled portions of the cleats 204. In the illustrated embodiment, the edge 528*a* is offset from the edge 528*b* in a direction parallel to the axis 530 of the hinge 516. In addition, one of the edges 528*a* may be spaced further from the hinge axis 530 than other edge 528*b*. In some embodiments, one of the edges may have a longer length than the other edge. As best illustrated in FIG. 19, the edge 528*a* of the first attachment portion 520 is mounted on the cleat 204, and the edge 528*b* of the second attachment portion 524 is mounted on an adjacent cleat 204. Stated another way, the edge 528*a* and the edge 528*b* provide a mounting interface. In the illustrated embodiment, the container 500 can be coupled to the rail 400 while the surface on which the hinge 516 is located (e.g., the rear surface 512) is positioned within one of the gaps 216 between adjacent cleats 204.

Figure 20:
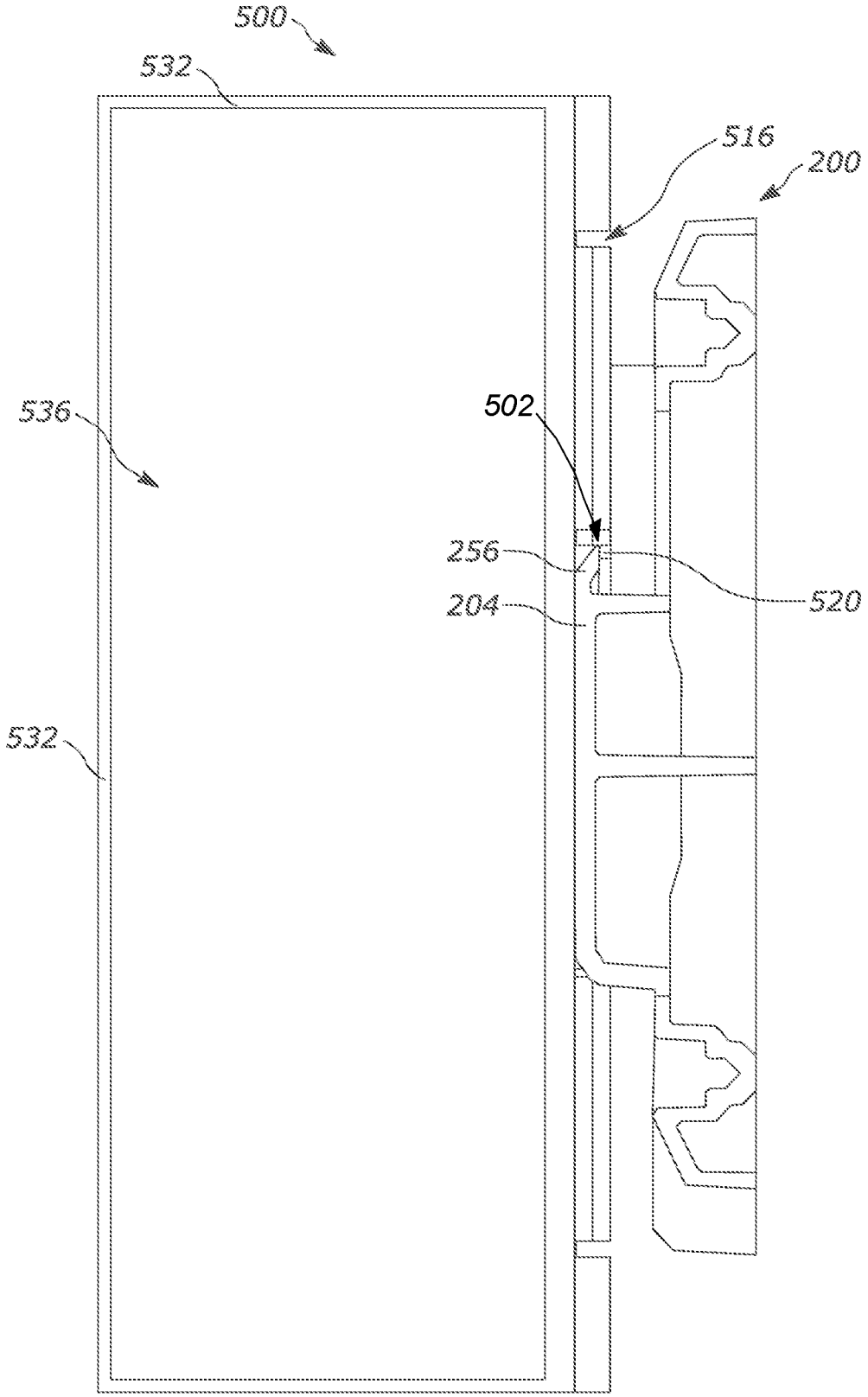
FIG. 20 is a cross-sectional view of the support panel and the third container viewed along section 20-20 in FIG. 19.
Figure 21:
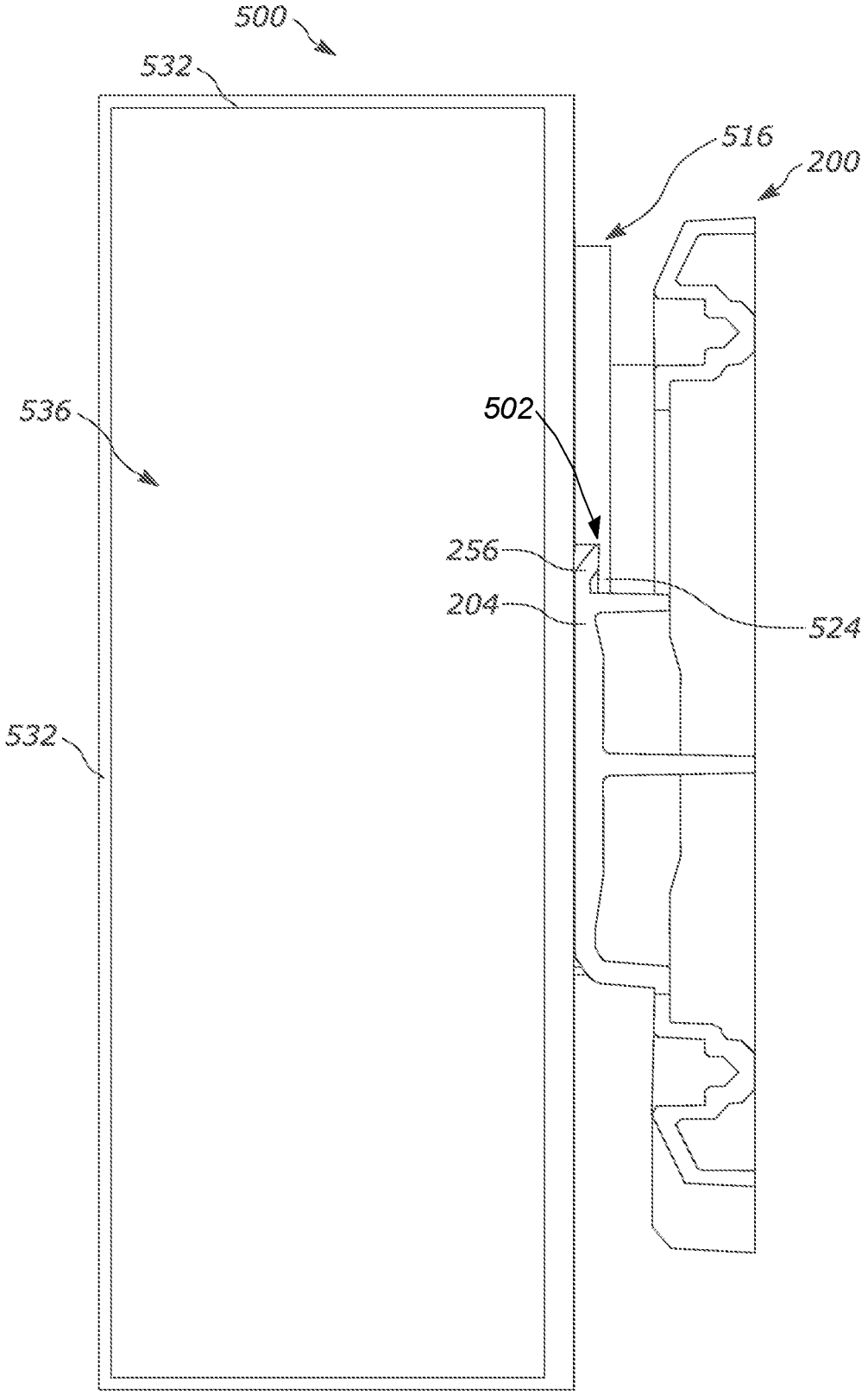
FIG. 21 is a cross-sectional view of the support panel and the third container viewed along section 21-21 in FIG. 19.

FIGS. 20 and 21 illustrate the connection between the rail 200 and the container 500. The container 500 may be translated along the axis 212 such that the edge 528*a* of the first attachment portion 520 and the edge 528*b* of the second attachment portion 524 each engage respective cleat lips 256. In the illustrated embodiment, each edge 528*a*, 528*b* is a lip that engages the cleat lip 256 in a complementary manner. Optionally, the container 500 is snap-fit with the cleats 204 with the edges 528*a*, 528*b* and the cleat lips 256. Optionally, the container 500 is secured between cleats 204 of adjacent rails 200 with the container 500 being located in partial gaps 220*a*, 220*b* of both of the adjacent rails 200.

Figure 22:
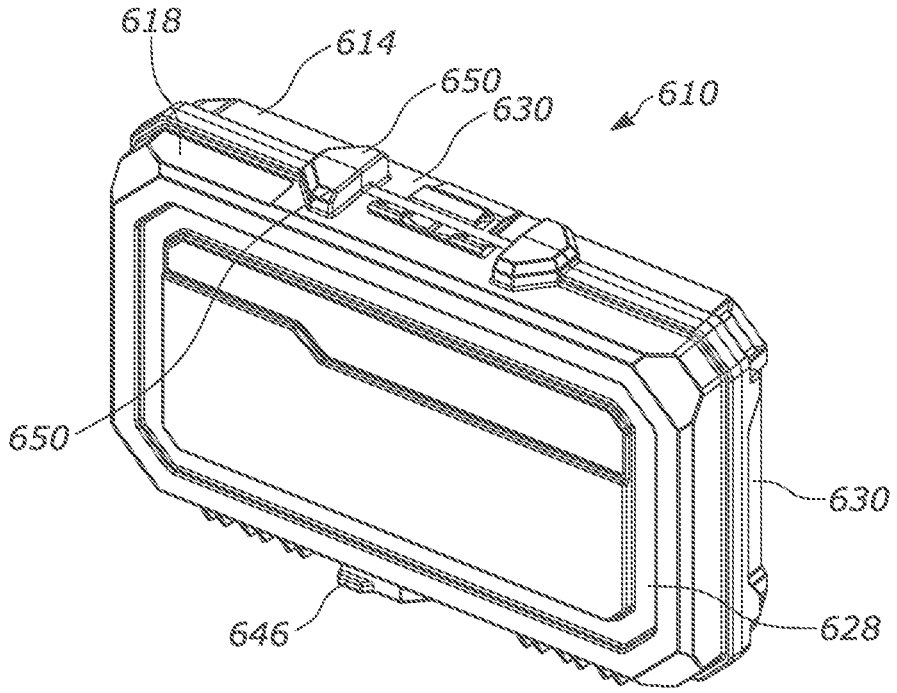
FIG. 22 is a front perspective view of a container according to another embodiment.
Figure 23:
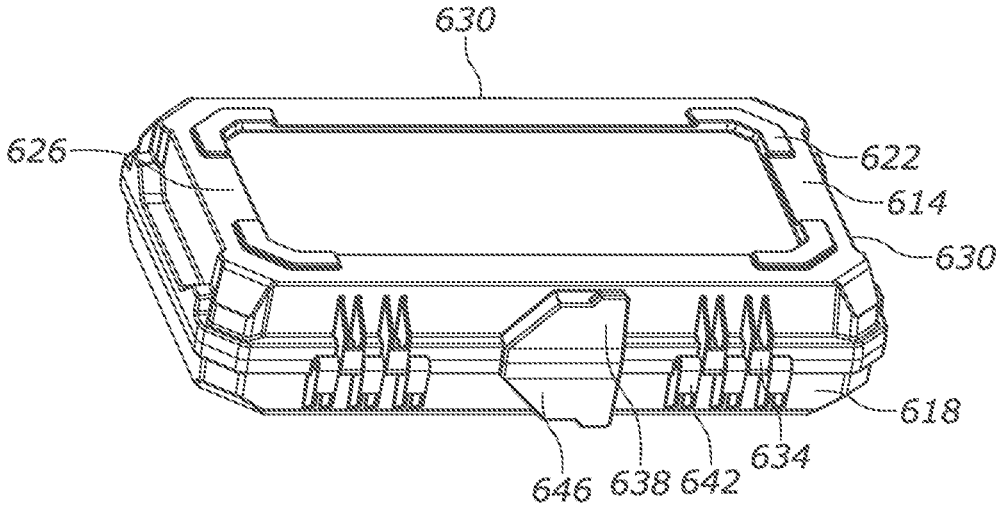
FIG. 23 is a rear perspective view of the container of FIG. 22.

FIGS. 22 and 23 illustrate a container 610. The container 610 is a drive ratchet and socket set assembly and includes a base 614 and a lid 618. The base 614 is provided with feet 622 extending downwardly from a bottom surface 626 of the base 614. The lid 618 includes a groove 628 configured to receive the feet 622 of the base 614 of another drive ratchet and socket set assembly 610. The base 614 also includes sidewalls 630 extending upwardly from the bottom surface 626. One of the sidewalls 630 has a hinge mechanism 634 and a support feature, such as a cleat engagement structure 638. The lid 618 has a corresponding hinge mechanism 642 and a support feature, or cleat engagement structure 646. The cleat engagement structures 638, 646 may removably couple the container 610 to at least one of the cleats 204 of the rail 200. In other words, the cleat engagement structures 638, 646 function as mount portions. In the illustrated embodiment, the cleat engagement structures 638, 646 together are dimensioned to engage adjacent the cleats 204 of the rail 200. Other dimensioning of the cleat engagement structures 638, 646 may otherwise be configured to removably couple the container 610 to the rail 200. Opposite the hinge mechanisms 634, 642 and cleat engagement structures 638, 646, both the base 614 and the lid 618 include projections 650 which may to be related to a closure mechanism for securing the base 614 to the lid 618. Various sized sockets and a drive ratchet (not shown) are housed between the base 614 and the lid 618.

Figure 24:
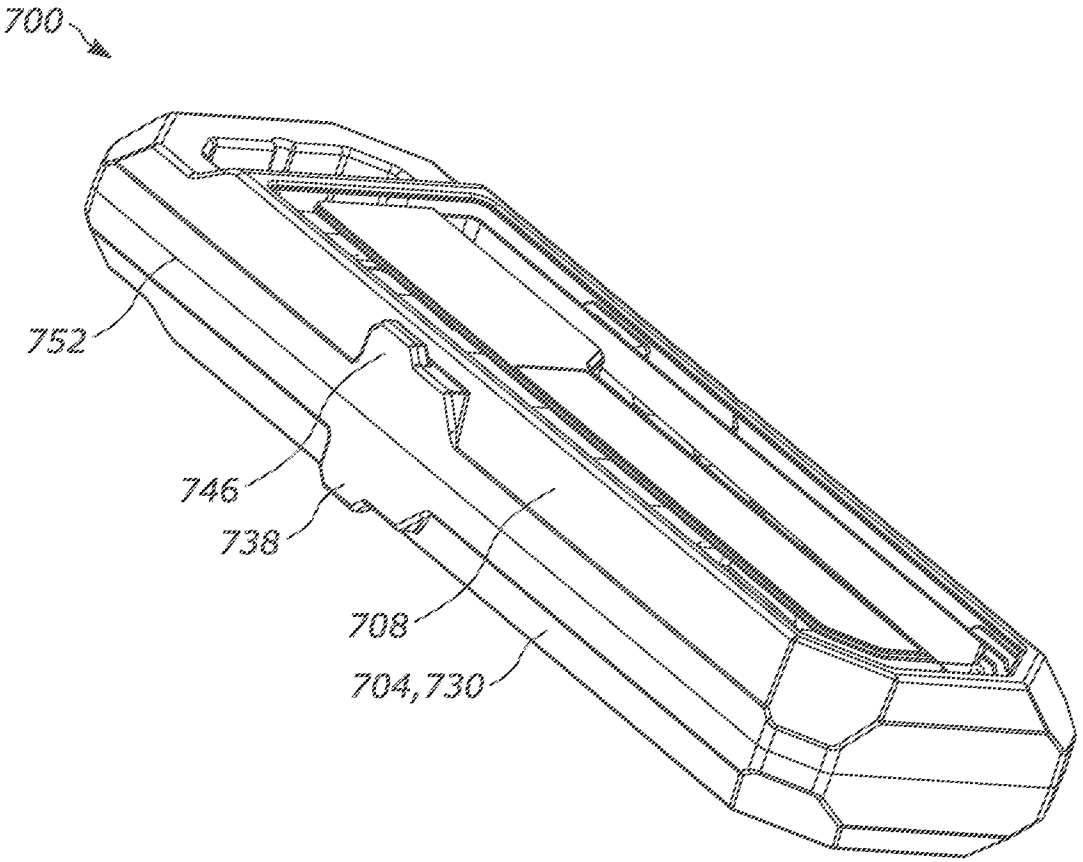
FIG. 24 is a front perspective view of a container according to another embodiment.
Figure 25:
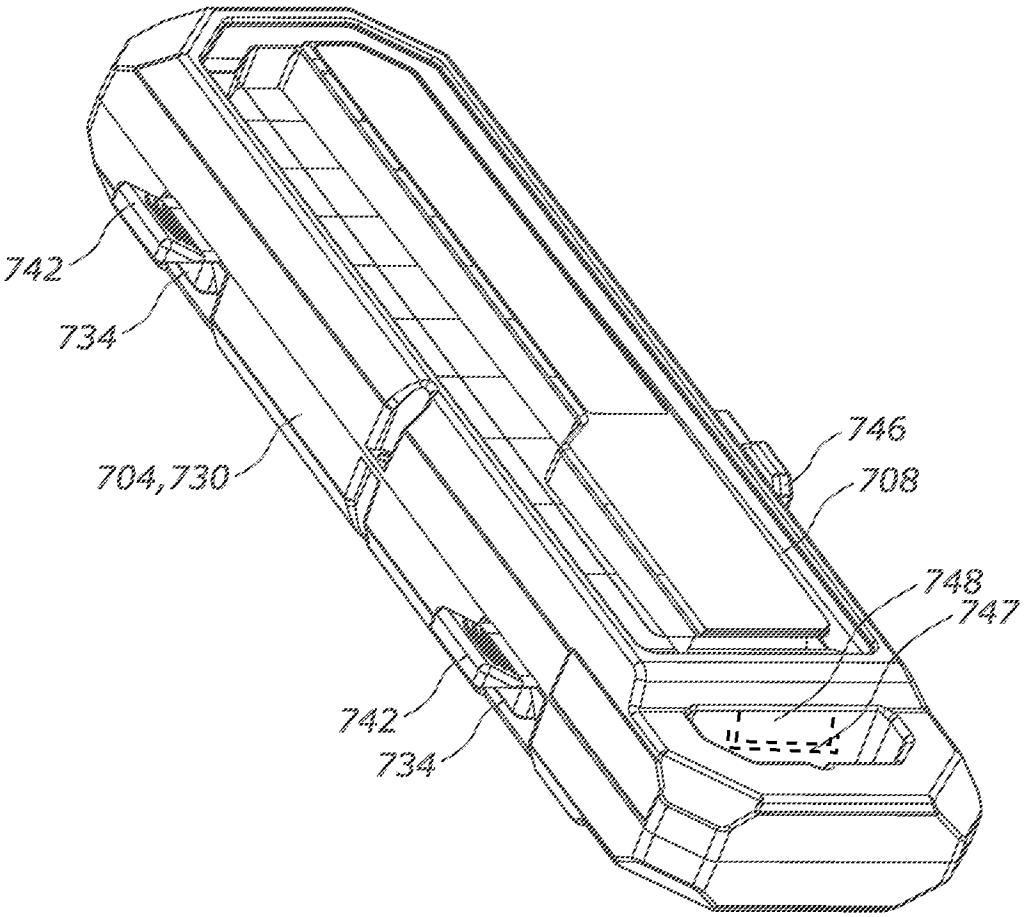
FIG. 25 is a rear perspective view of the container of FIG. 24.

FIGS. 24 and 25 illustrate a container 700. The container 700 is a deep impact socket set assembly 700 including a base 704 and a lid 708. The lid 708 includes a groove 728. The base 704 includes sidewalls 730 extending upwardly from a bottom surface 726 of the base 704. One of the sidewalls 730 has a closure mechanism 734. An opposite sidewall 730 has a Y-bracket feature 738. The lid 708 includes a closure member 742 to engage the closure mechanism 734. In the illustrated embodiment, the closure member 742 is rotatable relative to the lid 708 to selectively engage the closure mechanism 734 of the sidewall 730. Other closure members 742 and closure mechanisms 734 may secure the lid 708 to the sidewall 730. Opposite the closure member 742, the lid 708 includes a Y-bracket feature 746. The Y-bracket features 738, 746 may removably the container 700 to at least one of the cleats 204 of the rail 200. In other words, the Y-bracket features 738, 746 function as mount portions. In the illustrated embodiment, the Y-bracket features 738, 746 together are dimensioned to engage adjacent he cleats 204 of the rail 200. Other dimensioning of the Y-bracket features 738, 742 may otherwise be configured to removably couple the container 700 to the rail 200. The base 704 is dimensioned to receive a plurality of various sized sockets (not shown) therein. The base 704 also includes a depression 747 dimensioned to receive a projection 748 of the lid 708. The illustrated deep impact socket set assembly 700 further includes a living hinge 752 between the base 704 and the lid 708. Other hinges are possible.

Figure 26:
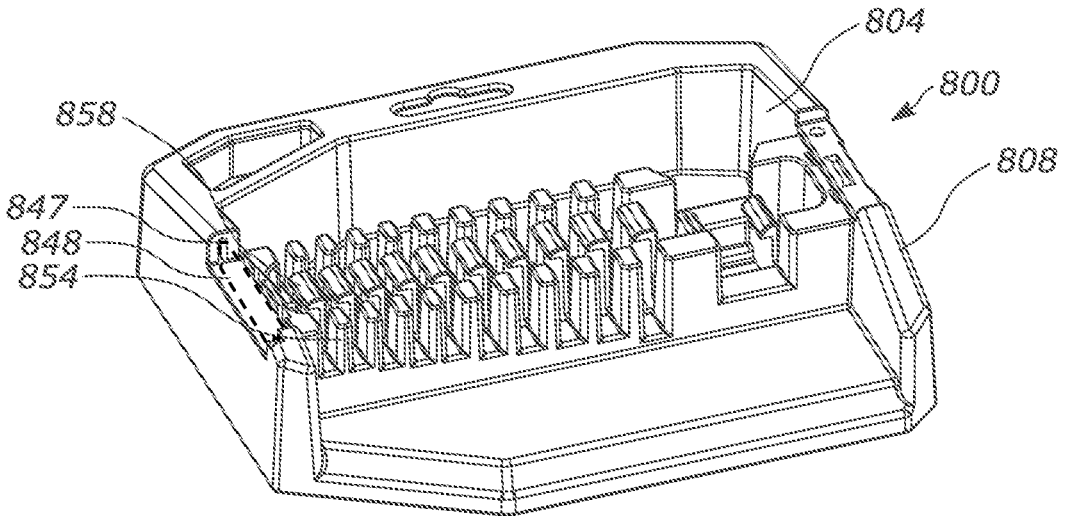
FIG. 26 is a front perspective view of a container according to another embodiment.
Figure 27:
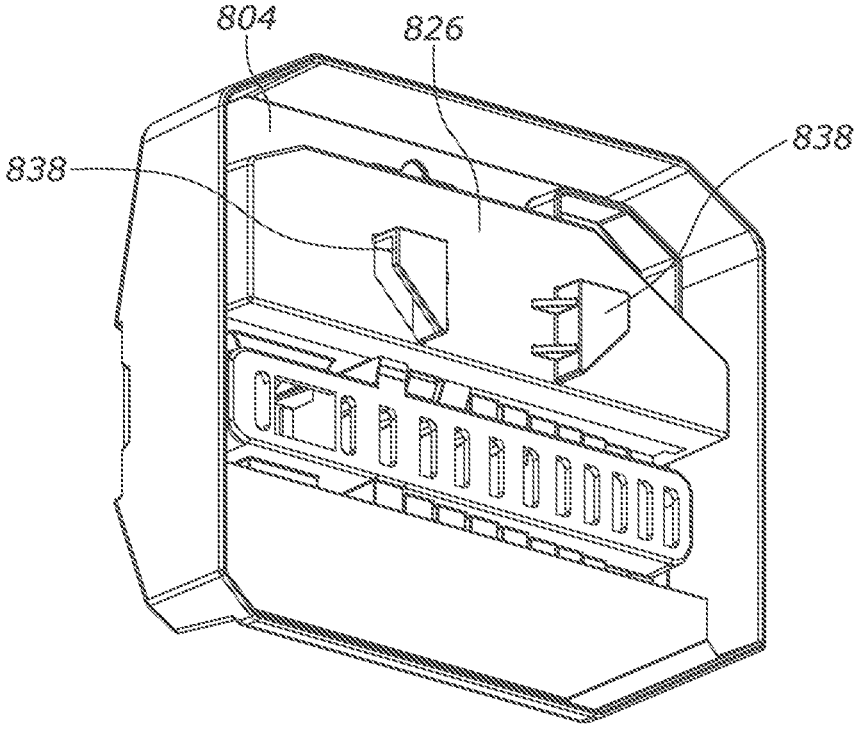
FIG. 27 is a rear perspective view of the container of FIG. 26.

FIGS. 26 and 27 relate to a container 800. The container 800 is a wrench set assembly 800 includes a base 804 and a lid 808. The base 804 includes a rear surface 826. Cleat engaging features 838 protrude from the rear surface 826, and are dimensioned to engage adjacent cleats 204 of the rail 200. In other words, the cleat engaging features 838 function as mount portions. The base 804 further includes a component engagement feature 854 protruding in a direction away from the rear surface 826, opposite the cleat engaging features 838 and generally towards the lid 808. Components (not shown) may be coupled to the base 804 by the component engagement features 854. The base 804 also includes a depression 847 dimensioned to receive a projection 848 of the lid 808. The wrench set assembly 800 further includes fingers 858 which secure wrenches to the engagement features if the lid 808 is removed.

Figure 28:
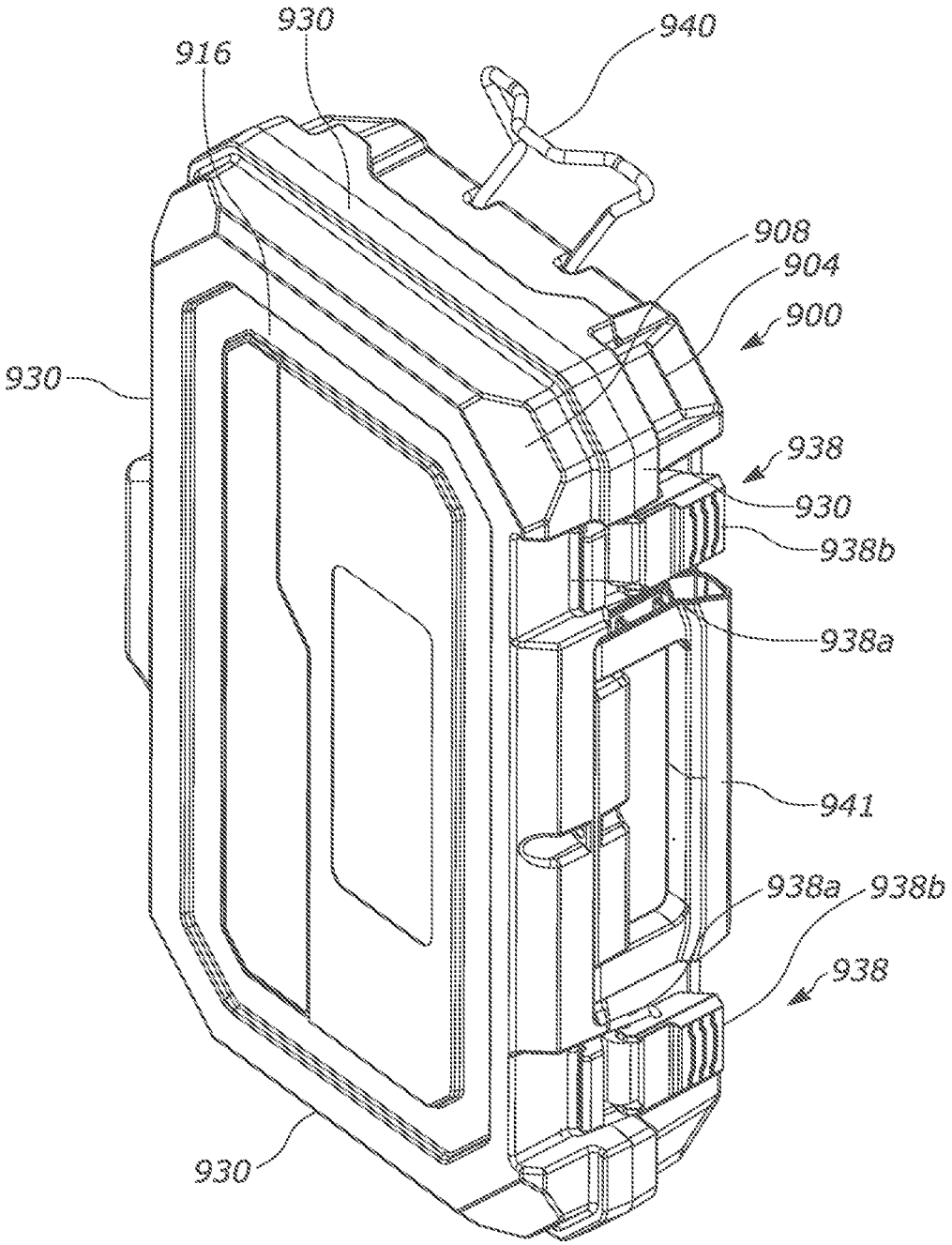
FIG. 28 is a front perspective view of a container according to another embodiment.
Figure 29:
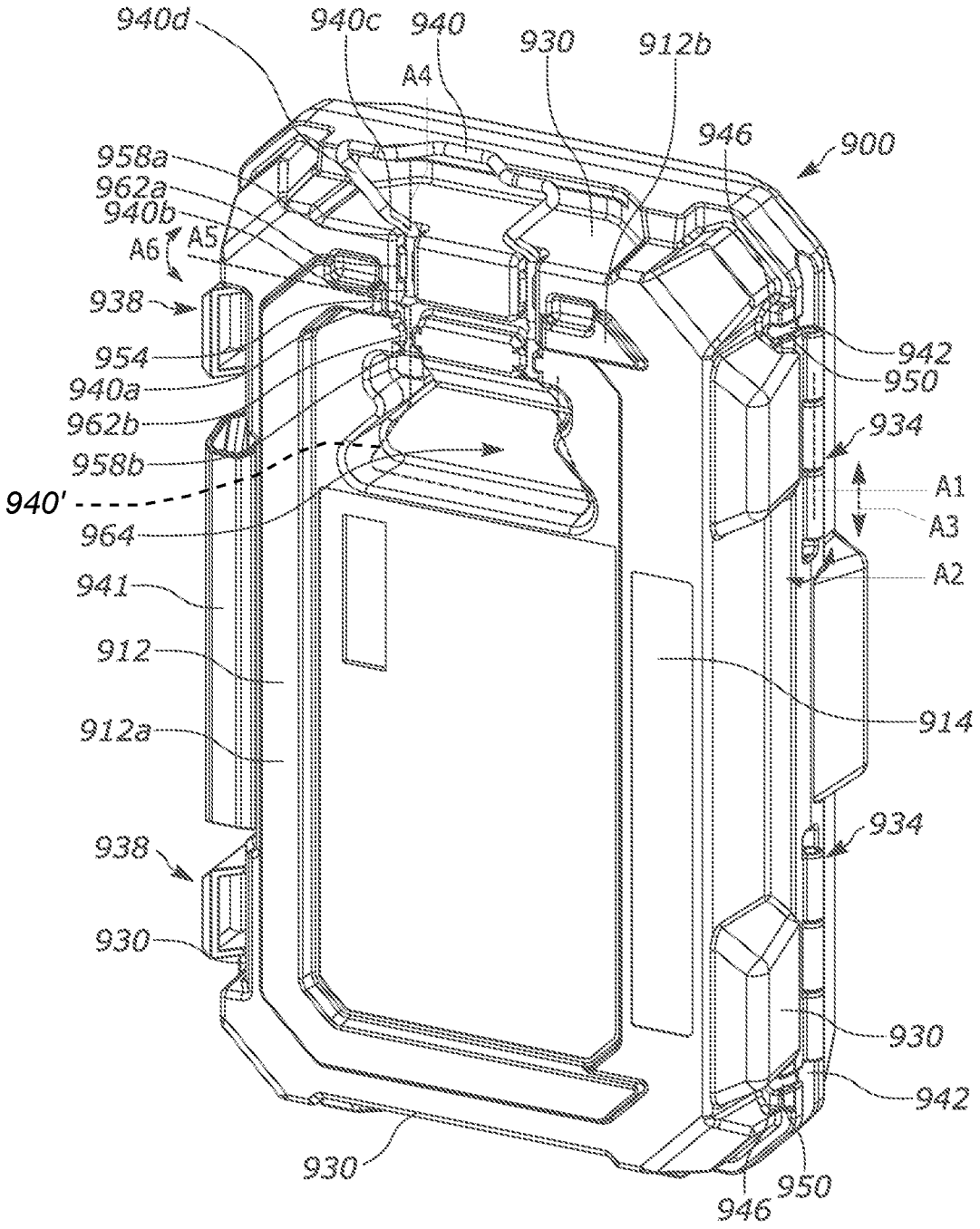
FIG. 29 is a rear perspective view of the container of FIG. 28.

FIGS. 28 and 29 relate to a container 900. The container 900 includes a base 904 and a lid 908. As best illustrated in FIG. 29, the base 904 is provided with a protrusion 912 extending downwardly from a bottom surface 914 of the base 904. The protrusion 912 includes a first portion 912*a* and a second portion 912*b* which is separate from the first portion 912*a*. The first portion 912*a* is dimensioned to correspond with three corners of the base 904. The second portion 912*b* is dimensioned to correspond with the fourth corner of the base 904. The lid 908 is provided with a groove 916 dimensioned to receive the protrusion 912 of the base 904 of another container 900. Accordingly, adjacent containers 900 can be easily stacked on one another. The base 904 also includes sidewalls 930 extending upwardly from the bottom surface 914. One of the sidewalls 930 is provided with at least one hinge mechanism 934. An opposite sidewall 930 is provided with a closure mechanism 938. Another sidewall 930 is provided with a fold-out hook 940. As described in detail below, the fold-out hook 940 is movable to selectively engage the cleat 204 or be recessed from the bottom surface 914. When in position to selectively engage the cleat 204, the fold-out hook 940 functions as a mount portion. Finally, the illustrated container 900 includes a handle 941 on the same sidewall as the closure mechanism 938. In the illustrated embodiment, the handle 941 is pivotable.

In the illustrated embodiment, the hinge mechanism 934 is a piano hinge where each of the base 904 and the lid 908 include lugs of the hinge mechanism 934. The hinge mechanism 934 includes a hinge pin 942 which is selectively coupled to the base 904 and the lid 908. When the hinge pin 942 is coupled to the base 904 and the lid 908 (as in FIG. 29), the hinge pin 942 is received within a hinge pin retainer 946 and is secured in position by a hinge pin finger 950. In this position, with the closure mechanism 938 unlocked (as will be described below) the base 904 and lid 908 are selectively rotatable relative to one another about a hinge pin axis A1. This rotation occurs along an arrow A2. To remove the base 904 from the lid 908, or vice versa, the hinge pin 942 itself can be pivoted about the hinge pin axis A1 relative to both the base 904 and the lid 908. This rotation also occurs about the arrow A2 until the hinge pin 942 overcomes a press-fit force applied by the hinge pin finger 950. Once the press-fit force is overcome by the hinge pin 942, the hinge pin 942 is removed from the hinge pin retainer 946 in a radial direction about the hinge pin axis A1. At this time, the hinge pin 942 can be translated along arrow A3 and the hinge pin axis A1 and removed from both the base 904 and the lid 908. The base 904 and lid 908 can then be removed from each other. The illustrated embodiment includes two hinge mechanisms 934. The same process to removably couple the hinge pin 942 may be applied to the other hinge mechanism 934. A reverse process may couple the hinge pin 942 to secure the base 904 to the lid 908.

The closure mechanism 938 of the container 900 includes a latch member 938*a* and an actuator 938*b*. The illustrated container 900 includes two closure mechanisms 938. In the illustrated embodiment, each closure mechanism 938 is on a sidewall 930 opposite the hinge mechanisms 934. The closure mechanisms 938 are movable between locked and unlocked positions. FIG. 28 illustrates the closure mechanisms 938 in the closed position with the latch member 938*a* securing the lid 908 to the base 904. To unlock the closure mechanisms 938, a user rotates the actuator 938*b* to release the latch member 938*a*. At this time, the lid 908 is pivotable relative to the base 904 about the hinge pin axis A1 as described above. When in the locked position, the closure mechanisms 938 inhibit rotation of the lid 908 relative to the base 904 about the hinge pin axis A1.

With continued reference to FIG. 29, in the illustrated embodiment, the fold-out hook 940 is movable to selectively engage the cleat 204 or be recessed form the bottom surface 914. When in a cleat engagement position (illustrated as 940, FIG. 29), the fold-out hook 940 is operable to engage at least one cleat 204 to secure the container 900 to the rail 200. When in a retracted position (illustrated in dashed lines as 940', FIG. 29), the fold-out hook 940' is recessed from the bottom surface 914. Accordingly, in the retracted position, containers 900 adjacent each other may be stacked with the protrusion 912 of one container 900 being received in the groove 916 of another container 900.

The fold-out hook 940 has several portions 940*a*, 940*b*, 940*c*, 940*d*. The first portion 940*a* of the fold-out hook 940 is located within a hole 954 of the base 904. The first portion 940*a* is pivotable within the hole 954. The second portion 940*b* is adjacent to the first portion 940*a*. The second portion 940*b* is generally perpendicular to the first portion 940*a*. The second portion 940*b* is received within a first hook retainer 958*a* in the closed position. The first hook retainer 958*a* includes a first hook finger 962*a* which provides a press-fit to secure the fold-out hook 940 in the cleat engagement position. The third potion 940*c* is adjacent the second portion 940*b*. The fourth portion 940*d* is adjacent to the third portion 940*c*. The third portion 940*c* is angled relative to the second portion 940*b* such that the fourth portion 940*d* protrudes from the bottom surface 914 and beyond the sidewall 930 when in the cleat engagement position (illustrated as 940, FIG. 29) and the fourth portion 940*d* is received within a recess 964 of the bottom surface 914 when in the retracted position (illustrated in dashed lines as 940', FIG. 29). In the illustrated embodiment, the third portion 940*c* is angled an angle A4 relative to the second portion 940*b*. The angle A4 has a first component in the same plane as the perpendicular angle between the first portion 940*a* and the second portion 940*b* and a second component perpendicular to the first component. In other words, the angle A4 is a three-dimensional angle with one of the dimensions being perpendicular to the connection between the first portion 940*a* and the second portion 940*b*. When in the cleat engagement position (illustrated as 940, FIG. 29), at least one of the third portion 940*c* and the fourth portion 940*d* can engage at least one cleat 204 to support the container 900 on the rail 200.

The first portion 940*a* extends generally along a hook axis A5, and a user may grasp the fold-out hook 940 or a portion (e.g., the fourth portion 940*d*) of the fold-out hook 940 to rotate the fold-out hook 940 about the hook axis A5 and along the arrow A6 to the retracted position (illustrated in dashed lines as 940', FIG. 29). In the retracted position of the fold-out hook 940', the second portion 940*b* is received within a second hook retainer 958*b*. The second hook retainer 958*b* includes a second hook finger 962*b* which provides a press fit to secure the fold-out hook 940 in the retracted position. In the illustrated embodiment, the base 904 includes two first hook retainers 958*a* and two second hook retainers 958*b*. Each hook retainer 958*a*, 958*b* includes two fingers 962*a*, 962*b*. In the illustrated embodiment, each finger 962*a*, 962*b* is generally cylindrically shaped, and extends into the retainer 958*a*, 958*b*. Accordingly, fold-out hook 940 is pivotably movable to protrude from the base 904 to selectively engage the cleat 204 or be recessed from the bottom surface 914.

Figure 30:
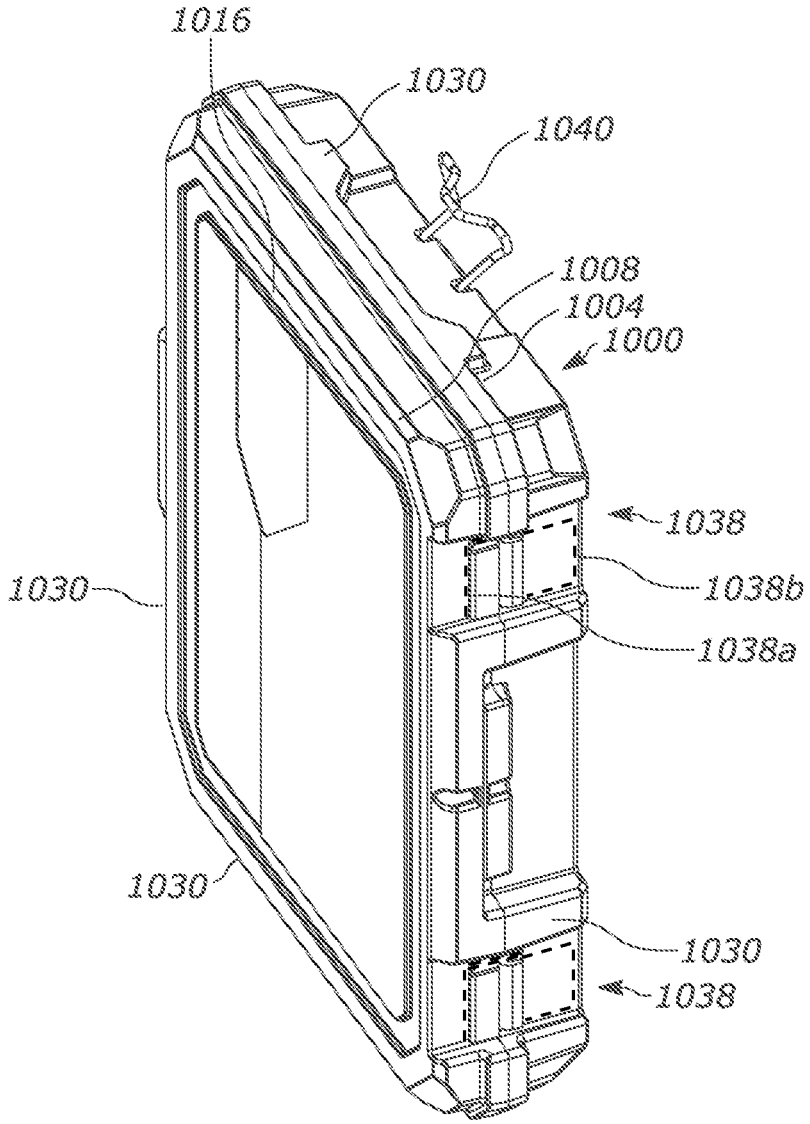
FIG. 30 is a front perspective view of a container according to another embodiment.
Figure 31:
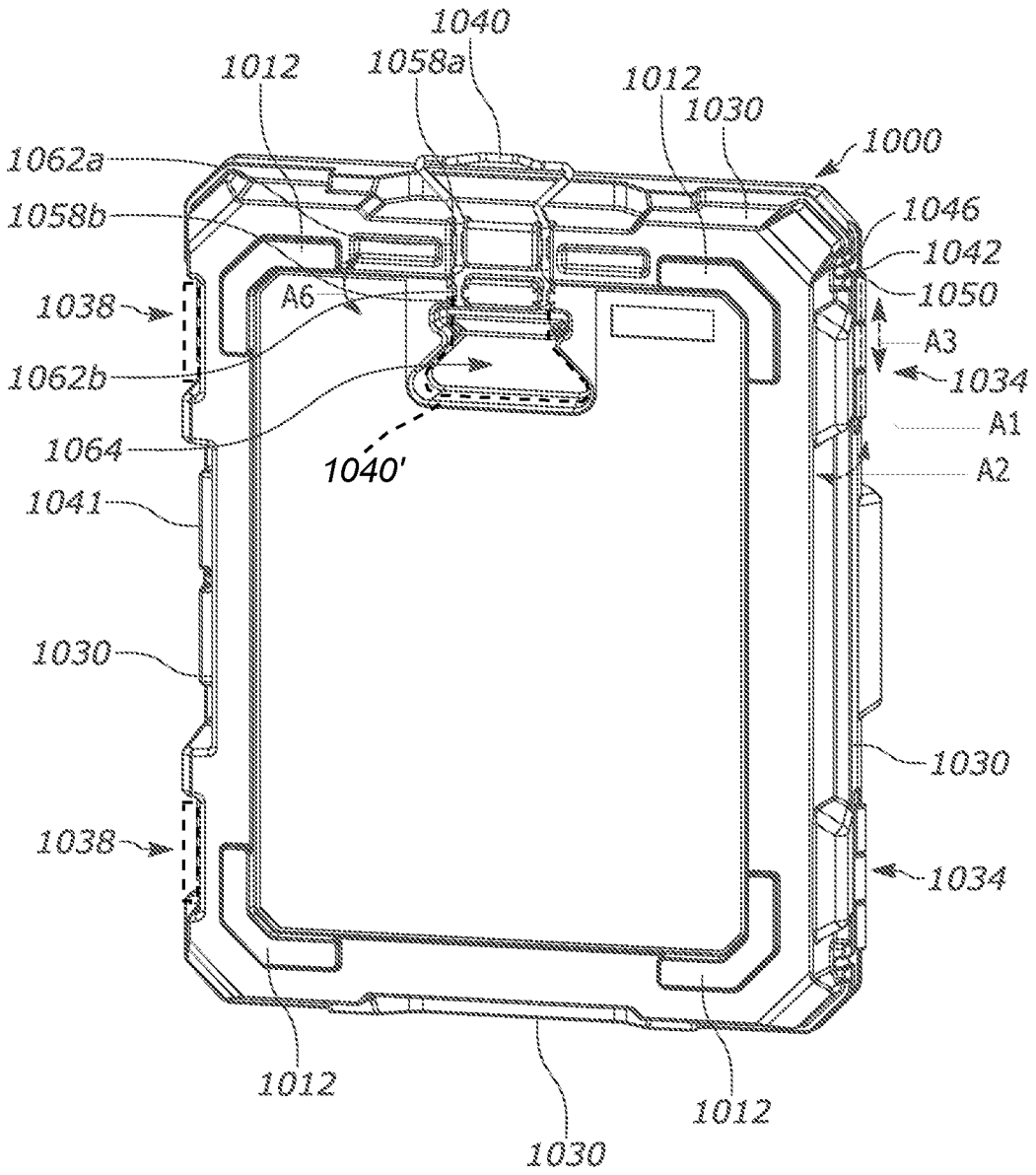
FIG. 31 is a rear perspective view of the container of FIG. 30.

FIGS. 30 and 31 relate to a container 1000 which is similar in many respects to the container 900. The container 1000 is dimensionally larger than the container 900. Common features between the container 900 and the container 1000 are illustrated with reference numerals added by "100" to correspond with the container 1000. For example, the container 1000 includes a fold-out hook 1040 similar to the fold-out hook 940 of the container 900. Accordingly, when in position to engage the cleat 204, the fold-out hook 1040 functions as a mount portion. Other than the size of the container 1000 being dimensionally larger than the container 900, the container 1000 includes a lid 1008 with a groove 1016 and a base 1004 having four protrusions 912 which each correspond with a corner of the base 1004. For clarity of FIG. 31, some reference numerals which are provided in FIG. 29 have been omitted. However, the fold-out hook 1040 functions similarly to the fold-out hook 940. Similarly, the hinge pin 1042 functions similarly to the hinge pin 942. The container 900 may be configured to stack upon the container 1000. In some embodiments, the container 900 may be stacked upon the container 1000 with the container 900 being angled approximately 90 degrees such that the container 900 is perpendicular to the container 1000. In one exemplary embodiment, one of the sidewalls 930 (e.g., the sidewall 930 corresponding with the closure mechanism 938) of the container 900 may be oriented perpendicular to a sidewall 1030 (e.g., the sidewall 1030 corresponding with the closure mechanism 1038) of the container 1000 in the stacked configuration.

Figure 32:
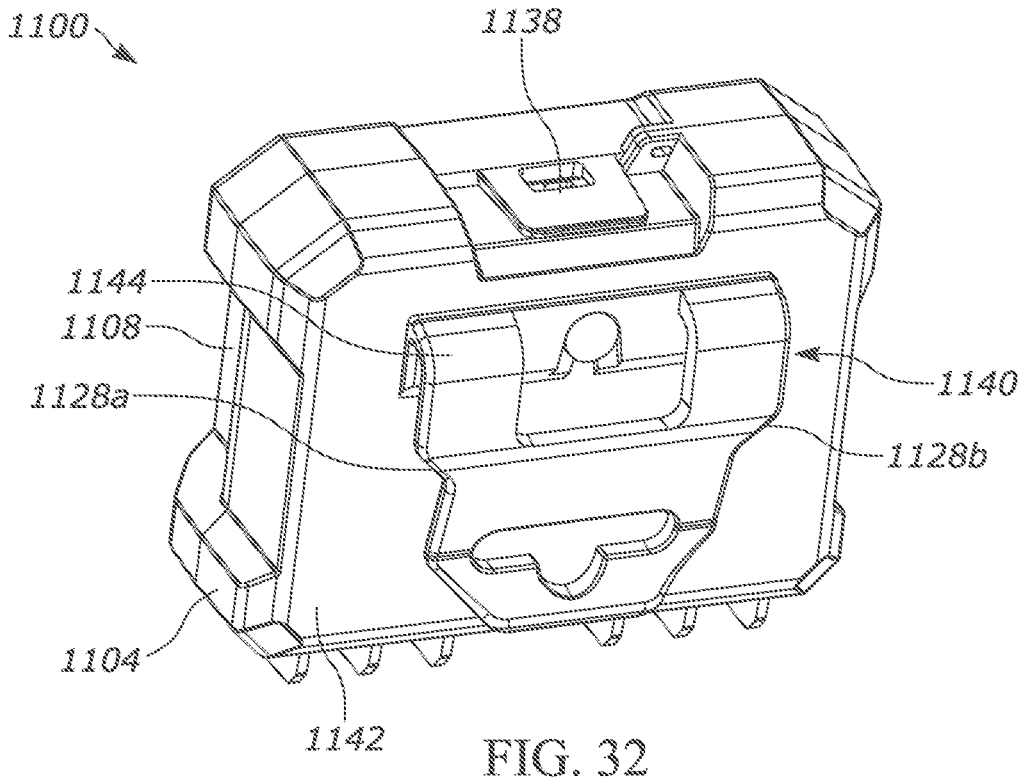
FIG. 32 is a perspective view of a container according to another embodiment.
Figure 33:
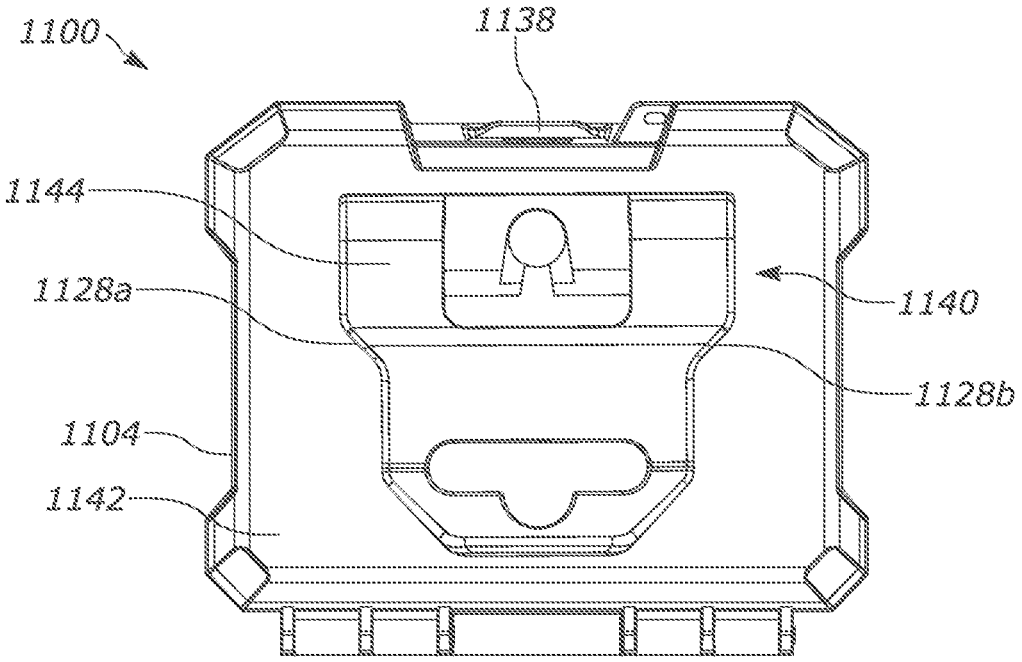
FIG. 33 is a plan view of the container of FIG. 32.

FIGS. 32 and 33 illustrate a container 1100 according to another embodiment. The container 1100 includes a first container portion 1104, a second container portion 1108 pivotably coupled to the first container portion 1104, and a latch 1138 for releasably securing the first container portion 1104 and the second container portion 1108. The container 1100 further includes a support feature, such as a clip or bracket 1140, for coupling the container 1100 to cleats 204 of the rail 200 (FIG. 2). In the illustrated embodiment, the bracket 1140 is supported on a surface 1142 of the container 1100 (e.g., a bottom surface), and the bracket 1140 includes a hook portion 1144 that is spaced apart from the surface 1142 of the container 1100. In addition, the bracket 1140 includes a first edge 1128*a* and a second edge 1128*b*. In the illustrated embodiment, the first edge 1128*a* and second edge 1128*b* are oriented at acute angles relative to a direction along which the container 1300 may be coupled to the rail 200 (e.g., a vertical direction). Stated another way, the first edge 1128*a* and 1128*b* are complementary to the angled surfaces of the cleats 204 and can engage the angled surfaces of two adjacent cleats 204 when positioned in the corresponding gap between two cleats 204. The clip or bracket 1140 therefore permits the container 1100 to engage multiple types of support structures; for example, the bracket 1140 of the container 1100 may be hooked to an article of clothing (e.g., a belt) or another structure, and alternatively the bracket 1140 container 1100 can be supported on the cleats 204 of the rail 200.

Figure 34:
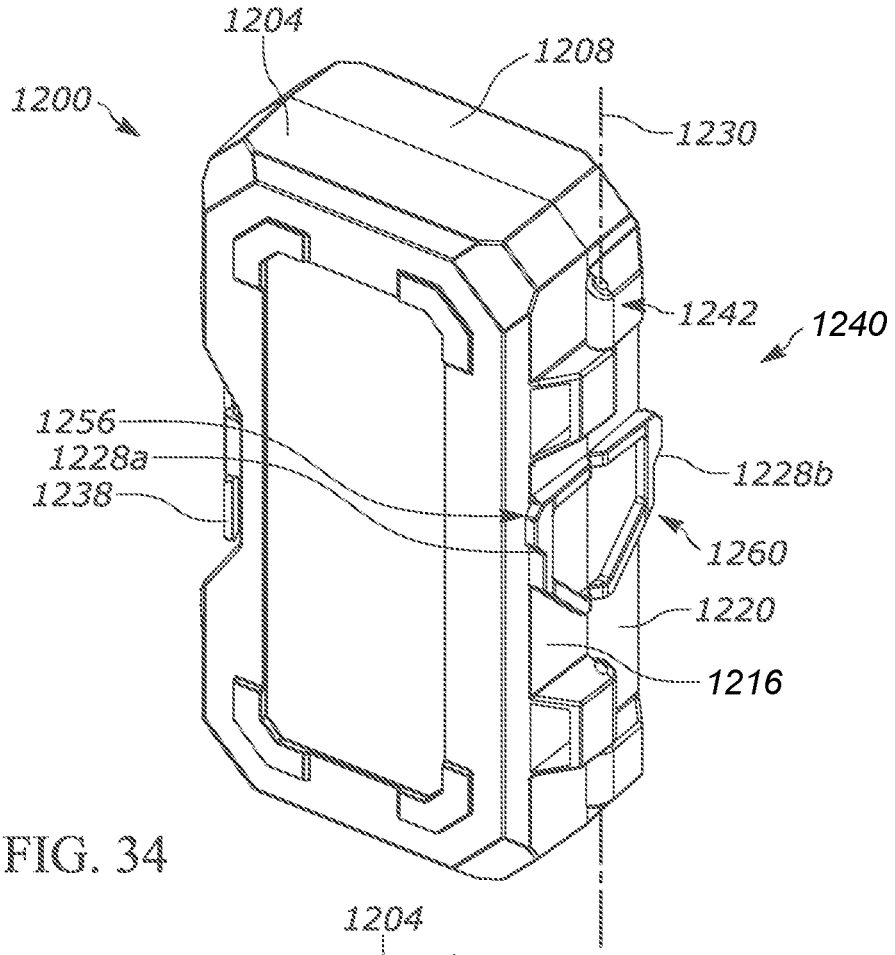
FIG. 34 is a perspective view of a container according to another embodiment.
Figure 35:
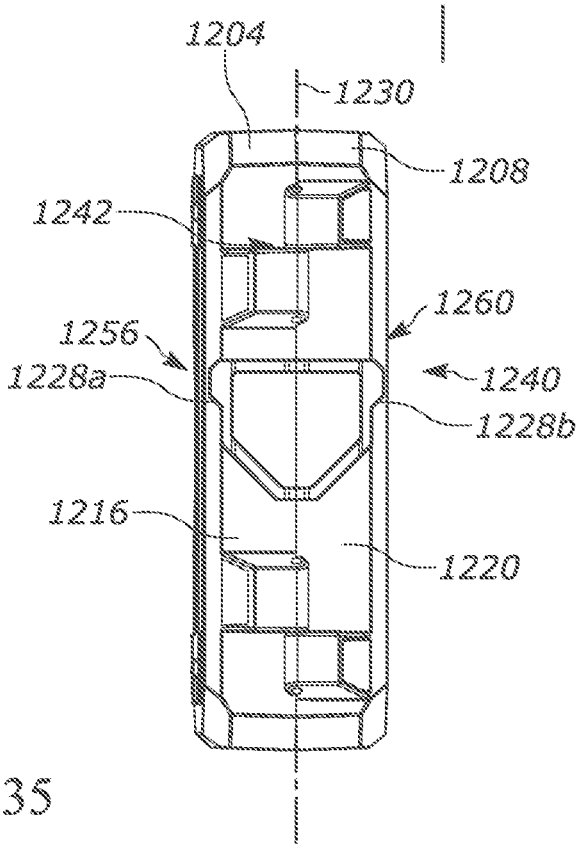
FIG. 35 is a side view of the container of FIG. 34.
Figure 36:
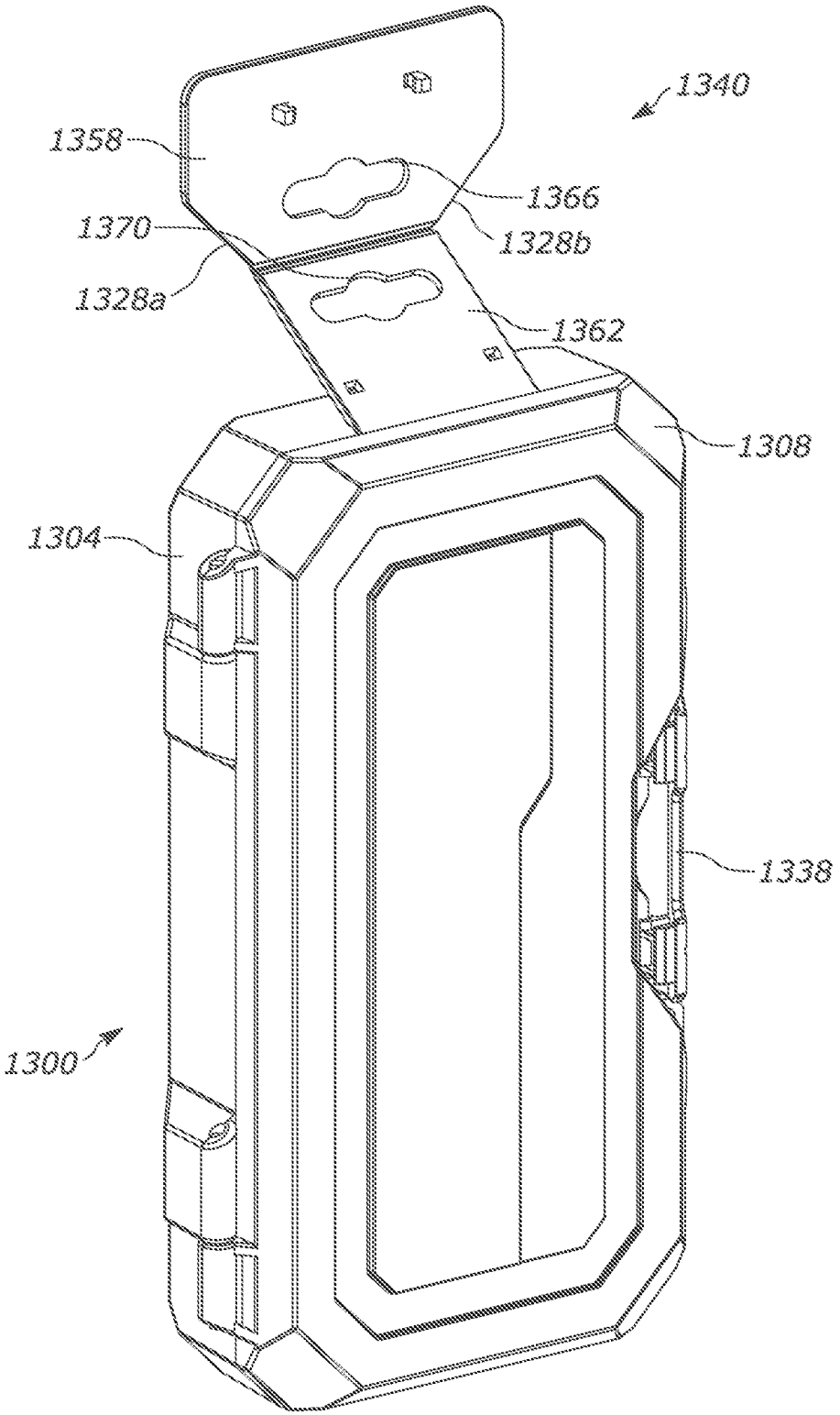
FIG. 36 is a perspective view of a container according to another embodiment, with a bracket in an extended position.

FIGS. 34 and 35 illustrate a container 1200 according to another embodiment. The container 1200 includes a first container portion 1204, a second container portion 1208 pivotably coupled to the first container portion 1204, and a latch 1238 for releasably securing the first container portion 1204 and the second container portion 1208. The container 1200 further includes a support feature 1240 for coupling the container 1200 to cleats 204 of the rail 200. In the illustrated embodiment, the support feature 1240 includes a first partial mounting portion 1256 and a second partial mounting portion 1260. The first partial mounting portion 1256 is positioned on one side of the first container portion 1204 (e.g., the rear side 1216), and the second partial mounting portion 1260 is positioned on one side of the second container portion 1208 (e.g., the rear side 1220). In the illustrated embodiment, the first partial mounting portion 1256 is formed integrally with the rear side 1216, and the second partial mounting portion 1260 is formed integrally with the rear side 1220. In other embodiments, the partial mounting portions 1256, 1260 may be coupled in a different manner.

The first partial mounting portion 1256 includes a first edge 1228*a*, and the second partial mounting portion 1260 includes a second edge 1228*b*. In the illustrated embodiment, the first edge 1228*a* and the second edge 1228*b* are oriented at acute angles relative to a pivot axis 1230 formed by a hinge 1242. The first edge 1228*a* and 1228*b* are complementary to the angled surfaces of the cleats 204 and can engage the angled surfaces of two adjacent cleats 204 when positioned in the corresponding gap between two cleats 204. In the illustrated embodiment, the support feature 1240 includes a recessed center portion; in other embodiments, the support feature 1240 may have no recess, such that the center portion is solid.

FIGS. 36-39 illustrate a container 1300 according to another embodiment. The container 1300 includes a first container portion 1304 (e.g., a base), a second container portion 1308 (e.g., a lid) pivotably coupled to the first container portion 1304, and a latch 1338 for releasably securing the first container portion 1304 and the second container portion 1308. The container 1300 further includes a support feature 1340 for coupling the container 1300 to cleats 204 of the rail 200 (FIG. 1). In the illustrated embodiment, the support feature 1340 includes a folding bracket having a first or engaging portion 1358 and a second or connecting portion 1362. The engaging portion 1358 includes a first edge 1328*a* and a second edge 1328*b*. In the illustrated embodiment, the first edge 1328*a* and the second edge 1328*b* are oriented at acute angles relative to a direction along which the container 1300 may be coupled to the rail 200 (e.g., a vertical direction—FIG. 39). Stated another way, the edges 1328*a*, 1328*b* are complementary to the angled surfaces of the cleats 204 and can engage the angled surfaces of two adjacent cleats 204 when positioned in the corresponding gap between two cleats 204.

Figure 37:
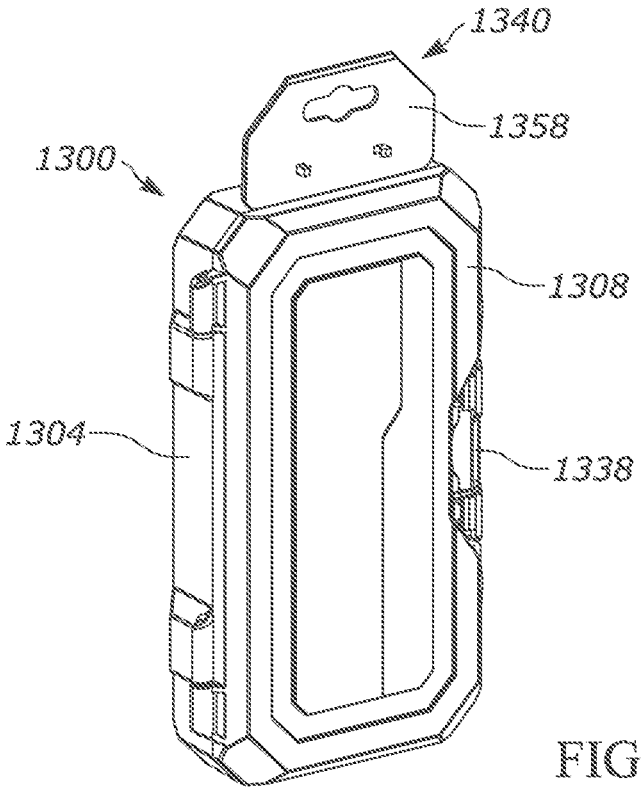
FIG. 37 is another perspective view of the container of FIG. 36, with the bracket in a folded configuration.
Figure 38:
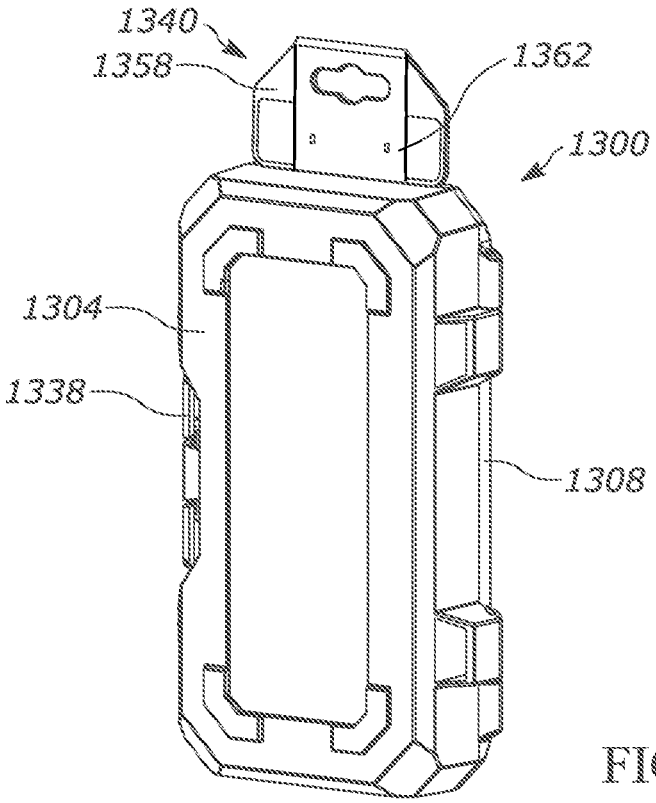
FIG. 38 is another perspective view of the container of FIG. 36, with the bracket in a folded configuration.
Figure 39:
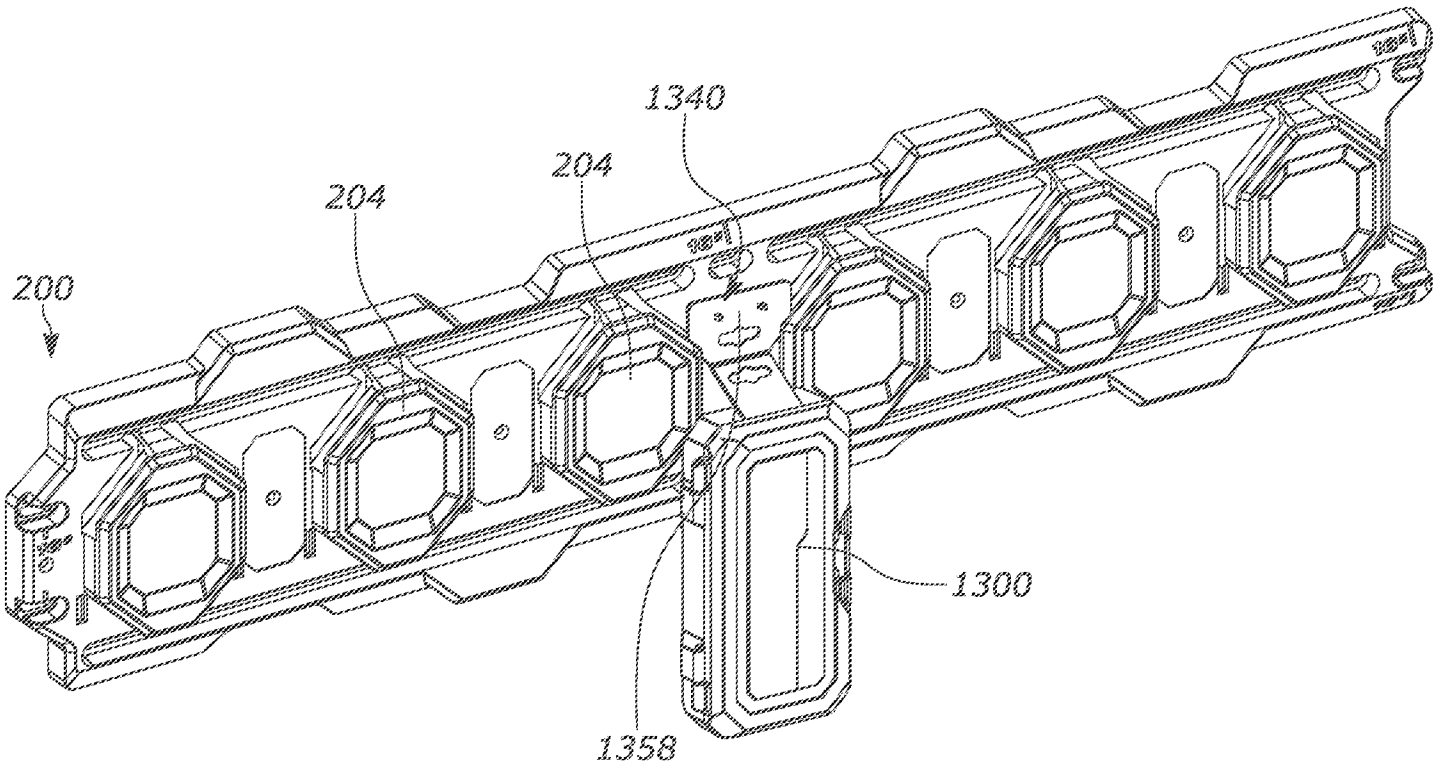
FIG. 39 is a perspective view of the container of FIG. 36 coupled to a wall support panel.

The connecting portion 1362 is coupled between the engaging portion 1358 and one of the container portions 1304, 1308. One end of the connecting portion 1362 may be pivotably coupled to one of the container portions 1304, 1308, and another end of the connecting portion 1362 may be pivotably coupled to the engaging portion 1358. In the illustrated embodiment, the connecting portion 1362 is coupled to the second container portion 1308. The engaging portion 1358 may be folded into a flat position against the connecting portion 1362, as shown in FIGS. 37 and 38. The engaging portion 1358 may include an opening 1366 and the connecting portion 1362 may include an opening 1370, and the openings 1366, 1370 may be aligned with one another while the engaging portion 1358 and the connecting portion 1362 are in the flat position, permitting the support feature to engaging a hook. Alternatively, the engaging portion 1358 may be extended from the connecting portion 1362 to engage the cleats 204 (FIG. 39). In the illustrated embodiment, the engaging portion 1358 is positioned adjacent a bottom surface of the first container portion 1304 while in the extended position. In other embodiments, the bracket 1340 may be coupled to the container in a different orientation.

Figure 40:
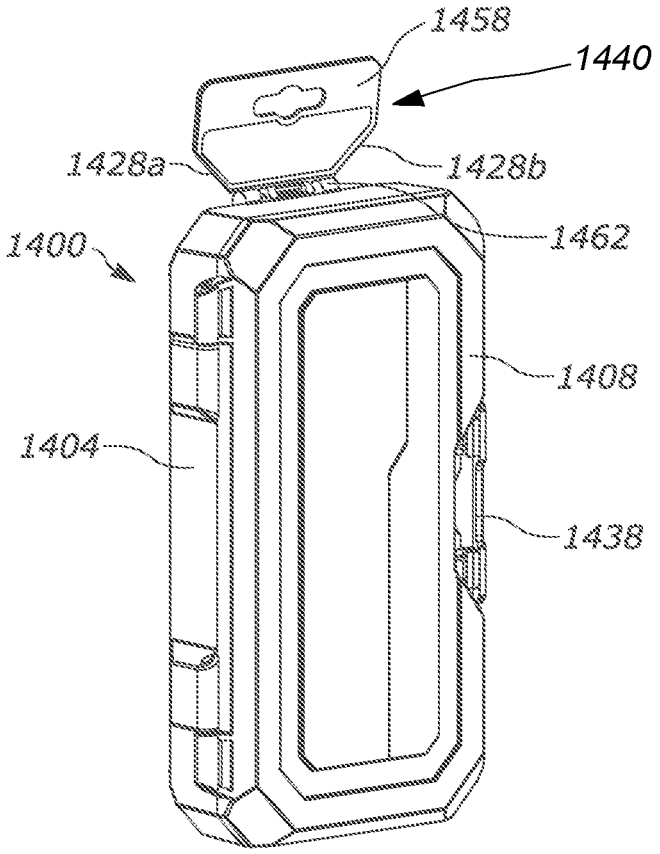
FIG. 40 is a perspective view of a container according to another embodiment, with a bracket in an extended position.
Figure 41:
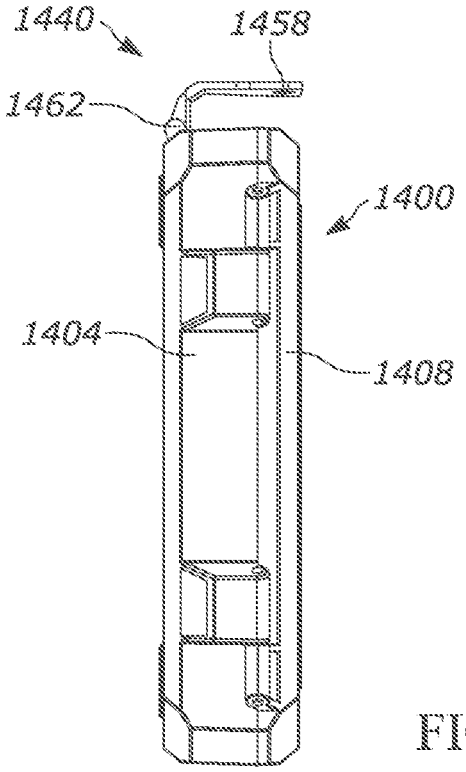
FIG. 41 is another perspective view of the container of FIG. 40, with the bracket in a folded configuration.
Figure 42:
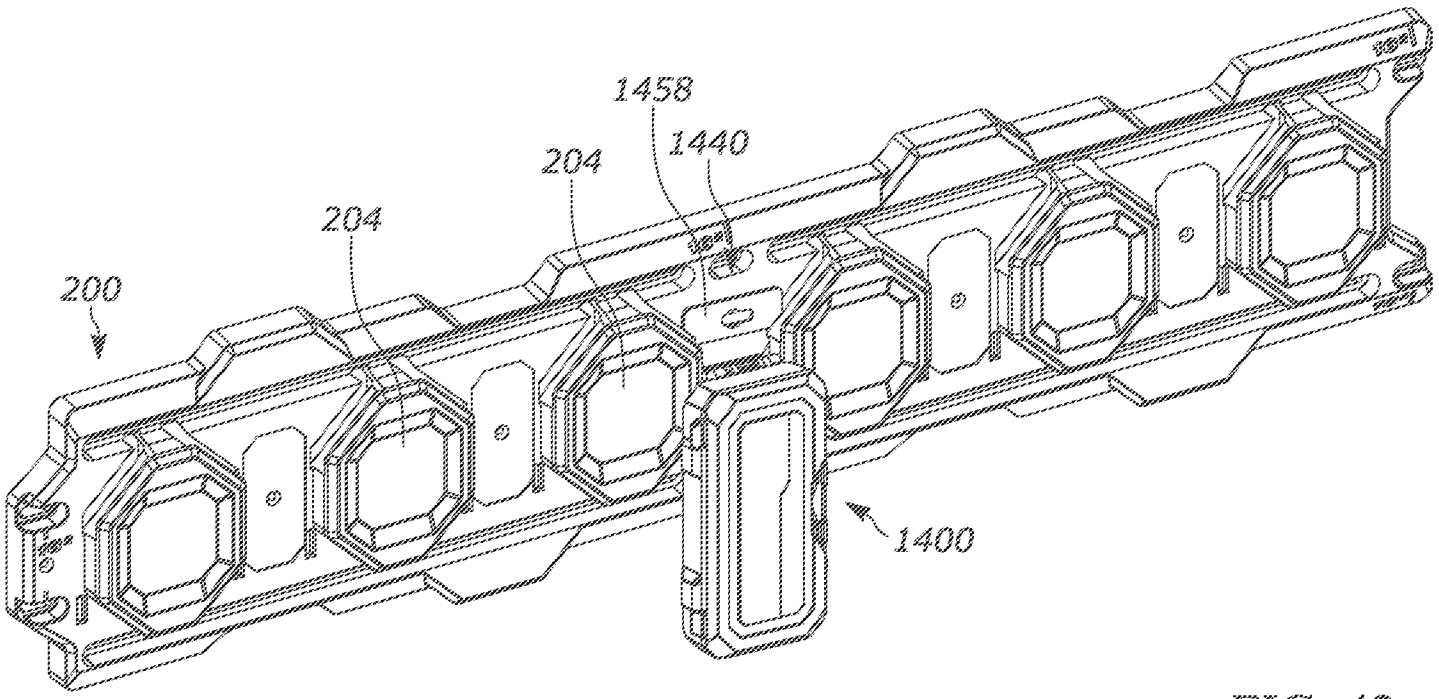
FIG. 42 is a perspective view of the container of FIG. 40 coupled to a support panel.

FIGS. 40-42 illustrate a container 1400 according to another embodiment. The container 1400 includes a first container portion 1404, a second container portion 1408 pivotably coupled to the first container portion 1404, and a latch 1438 for releasably securing the first container portion 1404 and the second container portion 1408. The container 1400 further includes a support feature 1440 for coupling the container 1400 to cleats 204 of the rail 200. In the illustrated embodiment, the support feature 1440 includes a folding bracket 1458 pivotably coupled to the first container portion 1404 (e.g., by a hinge 1462). The bracket 1458 is pivotable between a retracted position (FIG. 42) and an extended position (FIG. 40).

The bracket 1458 includes a first edge 1428*a* and a second edge 1428*b*. In the illustrated embodiment, while the bracket 1458 is in the extended position, the first edge 1428*a* and the second edge 1428*b* are oriented at acute angles relative to a direction along which the container 1400 may be coupled to the rail 200 (e.g., a vertical direction—FIG. 42). Stated another way, the edges 1428*a*, 1428*b* are complementary to the angled surfaces of the cleats 204 and can engage the angled surfaces of two adjacent cleats 204 when positioned in the corresponding gap between two cleats 204. In the illustrated embodiment, the bracket 1458 is positioned adjacent a bottom surface of the first container portion 1404 while in the extended position, and the bracket 1458 is oriented parallel to the sides of the container portions 1404, 1408 while in the retracted position. In other embodiments, the bracket 1440 may be coupled to the container in a different orientation.

Although aspects of the disclosure have been described in detail with reference to certain preferred embodiments, variations and modifications exist within the scope and spirit of one or more independent aspects as described.

What is claimed is:

1. A storage container comprising:

a first container portion including a first side and a second side;

a second container portion including a third side and a fourth side, the third side pivotably coupled to the first side of the first container portion by a hinge, the second container portion and the first container portion pivotably movable between a closed position and an open position, the fourth side and the second side being adjacent one another in the closed position and the fourth side and the second side being spaced apart from one another in the open position; and a support feature configured to engage a wall support system, the support feature including a first portion positioned on the first side of the first container portion and a second portion positioned on the third side of the second container portion.

2. The storage container of claim 1, wherein the support feature includes a first edge and a second edge, the first edge oriented at an acute angle relative to a pivot axis of the hinge, the second edge oriented at an acute angle relative to the pivot axis of the hinge.

3. The storage container of claim 2, wherein the first portion of the support feature includes the first edge and the second portion of the support feature includes the second edge.

4. The storage container of claim 1, wherein the first portion of the support feature and the second portion of the support feature are movable relative to one another as the first container portion and the second container portion move relative to one another, the first portion and the second portion being configured to engage the wall support system when the first container portion and the second container portion are in the closed position.

5. The storage container of claim 1, further comprising a latch for selectively securing the second container portion and the first container portion in the closed position.

6. The storage container of claim 1, wherein the support feature is a clip secured to the first container portion, the clip including a first edge, a second edge, and a hook, wherein the first edge and the second edge is selectively engageable with the cleats, and the hook is selectively engageable with an upper edge of a belt when the clip is not engaged with the cleat.

7. The storage container of claim 1, wherein the support feature is a support bracket protruding from a surface of the first container portion.

8. The storage container of claim 7, wherein the support bracket is movable between an extended position and a retracted position, the support bracket configured to engage the wall support system while the support bracket is in the extended position.

9. A storage system comprising:

a panel secured to a support surface, the panel including a plurality of cleats spaced apart from one another; and a storage container removably supported on the panel, the storage container including a first container portion including a first side and a second side, a second container portion including a third side and a fourth side, the third side pivotably coupled to the first side of the first container portion by a hinge, the second container portion and the first container portion are pivotably movable between a closed position and an open position, the fourth side and the second side being adjacent one another in the closed position, the fourth side and the second side being spaced apart from one another in the open position, and a support feature removably engaging at least one cleat, the support feature including a first portion positioned on the first side of the first container portion and a second portion positioned on the third side of the second container portion.

10. The storage system of claim 9, wherein adjacent cleats are spaced apart from one another by a gap, wherein the support feature is positioned between and engages two adjacent cleats.

11. The storage system of claim 9, wherein the support feature remains engaged with the cleat due to gravity.

12. The storage system of claim 9, wherein the support feature includes a first partial mounting portion positioned on the first container portion and a second partial mounting portion positioned on the second container portion, the first partial mounting portion and the second partial mounting portion forming a full mounting portion while the first container portion and the second container portion are in the closed position, the first partial mounting portion engaging one of the cleats the wall support system and the second partial mounting portion engaging an adjacent one of the cleats.

13. The storage system of claim 9, wherein the support feature includes a first edge and a second edge, the first edge oriented at an acute angle relative to a pivot axis of the hinge, the second edge oriented at an acute angle relative to the pivot axis of the hinge.

14. The storage system of claim 13, wherein the support feature includes a first portion positioned on the first side of the first container portion and a second portion positioned on the third side of the second container portion, the first portion including the first edge, the second portion including the second edge.

15. The storage system of claim 9, wherein the support feature is a clip secured to the first container portion, the clip including a first edge, a second edge, and a hook, wherein the first edge and the second edge is selectively engageable with the cleats, and the hook is selectively engageable with an upper edge of a belt when the clip is not engaged with the cleat.

16. The storage system of claim 9, wherein the support feature is a bracket protruding from a surface of the first container portion.

17. The storage system of claim 16, wherein the bracket is movable between an extended position and a retracted position, the support bracket engageable with the cleats while the bracket is in the extended position.

18. A storage container comprising:

a first container portion;

a second container portion;

a hinge coupling a first side of the first container portion and a second side of the second container portion for pivoting movement about a pivot axis, the first container portion and the second container portion pivotably movable between a closed position and an open position;

a latch releasably securing the first container portion and the second container portion in the closed position; and a support feature configured to engage a wall support system, the support feature including a first partial mounting portion positioned on the first container portion and a second partial mounting portion positioned on the second container portion, the first partial mounting portion and the second partial mounting portion forming a full mounting portion while the first container portion and the second container portion are in the closed position, and the first partial mounting portion and the second partial mounting portion configured to engage the wall support system.

19. The storage container of claim 18, wherein the first partial mounting portion includes a first edge and the second partial mounting portion includes a second edge, the first edge oriented at an acute angle relative to the pivot axis, the second edge oriented at an acute angle relative to the pivot axis.

20. The storage container of claim 19, wherein the first edge is configured to engage a first cleat of the wall support system, and the second edge is configured to engage an adjacent cleat of the wall support system.

* * * * *